US012584244B2

(12) United States Patent
Fukuda

(10) Patent No.: US 12,584,244 B2
(45) Date of Patent: Mar. 24, 2026

(54) MANUFACTURING METHOD FOR COLORED NONWOVEN FABRIC

(71) Applicant: KAO CORPORATION, Tokyo (JP)

(72) Inventor: Teruyuki Fukuda, Wakayama (JP)

(73) Assignee: KAO CORPORATION, Tokyo (JP)

( * ) Notice: Subject to any disclaimer, the term of this patent is extended or adjusted under 35 U.S.C. 154(b) by 438 days.

(21) Appl. No.: 17/787,844

(22) PCT Filed: Dec. 22, 2020

(86) PCT No.: PCT/JP2020/048002

§ 371 (c)(1),
(2) Date: Jun. 21, 2022

(87) PCT Pub. No.: WO2021/132260

PCT Pub. Date: Jul. 1, 2021

(65) Prior Publication Data

US 2023/0037752 A1 Feb. 9, 2023

(30) Foreign Application Priority Data

Dec. 23, 2019 (JP) ..... 2019-232097

(51) Int. Cl.
*D01D 5/00* (2006.01)
*D01F 1/04* (2006.01)
(Continued)

(52) U.S. Cl.
CPC ..... *D01D 5/003* (2013.01); *D01F 1/04* (2013.01); *D01F 1/06* (2013.01); *D01F 2/00* (2013.01);
(Continued)

(58) Field of Classification Search
CPC ..... D01D 5/003
See application file for complete search history.

(56) References Cited

U.S. PATENT DOCUMENTS 3,425,788 A * 2/1969 Wyatt ..... D06Q 1/02 8/129
4,034,751 A 7/1977 Hung
(Continued)

FOREIGN PATENT DOCUMENTS

CN 1247807 A 3/2000
CN 102978721 A 3/2013
(Continued)

OTHER PUBLICATIONS

Shen et al., Rete ridges: Morphogenesis, function, regulation, and reconstruction, 2023, Acta Biomaterialia, vol. 115, pp. 19-34 (Year: 2023).*

(Continued)

*Primary Examiner* — Timothy Kennedy
(74) *Attorney, Agent, or Firm* — Oblon, McClelland, Maier & Neustadt, L.L.P.

(57) ABSTRACT

A process for producing a colored nonwoven fabric that contains a colorant and nanofibers, which includes the step of injecting a polymer compound A by an electrospinning method to deposit the nanofibers on a surface of a collector, in which the surface of the collector on which the nanofibers are deposited is at least partially formed into an uneven shape.

16 Claims, 4 Drawing Sheets

(51) Int. Cl.

| | |
|---|---|
| ***D01F 1/06*** | (2006.01) |
| ***D01F 2/00*** | (2006.01) |
| ***D01F 6/14*** | (2006.01) |
| ***D04H 1/728*** | (2012.01) |
| ***D06B 11/00*** | (2006.01) |

(52) U.S. Cl.

CPC ..... *D01F 6/14* (2013.01); *D04H 1/728* (2013.01); *D06B 11/00* (2013.01); *D06B 2700/36* (2013.01)

(56) References Cited

U.S. PATENT DOCUMENTS

| | | | | |
|---|---|---|---|---|
| 4,132,821 | A | 1/1979 | Hiers et al. | |
| 2013/0142852 | A1 | 6/2013 | Tojo et al. | |
| 2015/0265030 | A1 | 9/2015 | Kusukame et al. | |
| 2019/0059551 | A1 | 2/2019 | Amari et al. | |
| 2020/0054440 | A1* | 2/2020 | Aguilar | B33Y 10/00 |
| 2020/0121573 | A1 | 4/2020 | Onodera et al. | |
| 2021/0128792 | A1* | 5/2021 | Dunbar | A61L 27/26 |

FOREIGN PATENT DOCUMENTS

| | | | |
|---|---|---|---|
| CN | 106668937 | A | 5/2017 |
| CN | 206293076 | U | 6/2017 |
| CN | 107227558 | A | 10/2017 |
| CN | 108135788 | A | 6/2018 |
| CN | 110191726 | A | 8/2019 |
| JP | 2006-328562 | A | 12/2006 |
| JP | 2011-127259 | A | 6/2011 |
| JP | 2011-173851 | A | 9/2011 |
| JP | 2012-12339 | A | 1/2012 |
| JP | 2014-152160 | A | 8/2014 |
| JP | 2015-193604 | A | 11/2015 |
| JP | 2016-190825 | A | 11/2016 |
| WO | WO 2019/009002 | A1 | 1/2019 |

OTHER PUBLICATIONS https://www.celanese.com/en/products/cellulose-acetate-flake (retrieved Apr. 16, 2025) (Year: 2025).*

International Search Report issued Mar. 16, 2021 in PCT/JP/2020/048002 filed Dec. 22, 2020, 2 pages.

Guanwen et al., "New Advances in Membrane Technology and Engineering Applications ", National Defense Industry Press, Aug. 31, 2013, pp. 124-126 (with unedited computer-generated English Translation).

Partial Supplementary European Search Report issued Jan. 9, 2025 in European Patent Application No. 20905591.2, 13 pages.

Office Action (EESR) issued on Apr. 15, 2025, in corresponding EP Application No. 20905591.2.

* cited by examiner

MANUFACTURING METHOD FOR COLORED NONWOVEN FABRIC

CROSS-REFERENCE TO RELATED APPLICATIONS

The present application is a 35 U.S.C. § 371 national stage application of International patent application PCT/JP2020/048002, filed Dec. 22, 2020, which is based on and claims the benefit of priority to Japanese Application No. 2019-232097, filed Dec. 23, 2019. The entire contents of these applications are incorporated herein by reference.

FIELD OF THE INVENTION

The present invention relates to a process for producing a colored nonwoven fabric.

BACKGROUND OF THE INVENTION

In recent years, as a means for simply performing makeup or tattooing on a body surface (skin), a foundation tape or a tattoo seal has now been commercially available.

The foundation tape has been used in the applications for hiding various scars, such as gash, burn scars, bruises, operation scars, etc., which can be hardly concealed merely by a concealer or a foundation.

On the other hand, the tattoo seal aims at temporally applying decorations, such as patterns, characters, tattoos, etc., to the skin. In this case, the skin can be returned to its original appearance by removing the tattoo seal from the skin, and therefore the tattoo seal has been often used to easily enjoy face painting or body painting upon sports events, etc.

For example, JP 2016-190825A (Patent Literature 1) discloses a skin seal that is attached to a human skin for hiding tattoos, scars, bruises or spots (blemishes), and includes a base material, a separator, a matte layer disposed on the base material, a release agent layer disposed on the matte layer, an adhesive layer disposed on the separator, a resilient layer disposed between the release agent layer and the adhesive layer and an ink layer disposed between the release agent layer and the adhesive layer.

In addition, JP 2012-12339A (Patent Literature 2) aims at providing a sheet-like cosmetic material for makeup which has a high sense of unity with a skin in appearance when attached thereto and a high effect of diminishing fine unevenness of a skin surface, such as fine wrinkles and pores, etc., and further exhibits a high effect of concealing skin color unevenness, such as spots, etc., and discloses a sheet-like cosmetic material for makeup which includes a nanofiber sheet formed of a polymer compound containing a coloring pigment, and the like.

SUMMARY OF THE INVENTION

The present invention relates to a process for producing a colored nonwoven fabric that contains a colorant and nanofibers, including the step of injecting a polymer compound A by an electrospinning method to deposit the nanofibers on a surface of a collector, in which the surface of the collector on which the nanofibers are deposited is at least partially formed into an uneven shape.

DETAILED DESCRIPTION OF THE INVENTION

Figure 1:
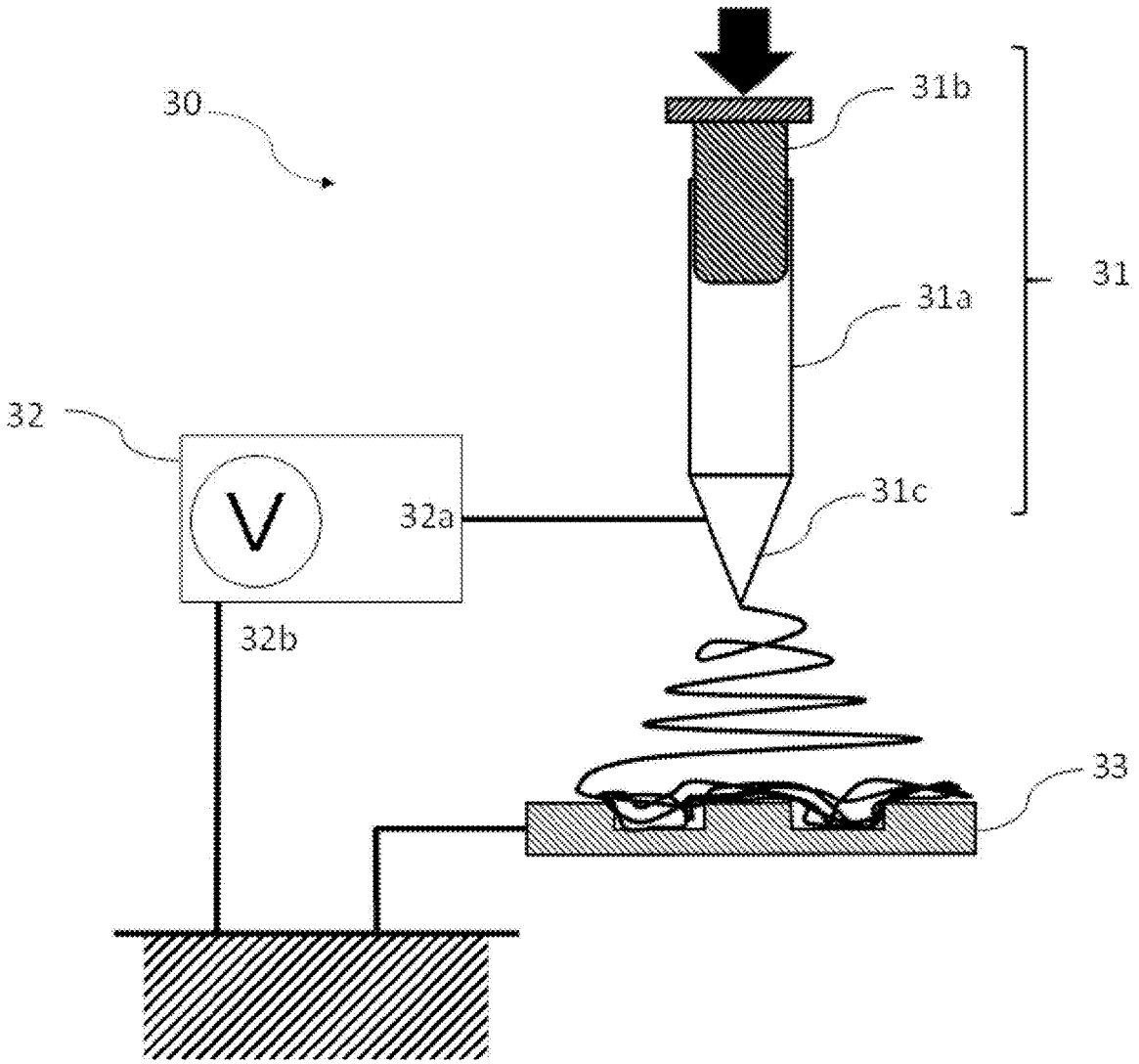
FIG. 1 is a schematic view showing one example of a resin solution-type electrospinning apparatus.

An appearance of skin is an important factor for humans to give a good impression to another person. To improve the appearance of skin, when applying makeup, e.g., a base makeup, such as a foundation, a concealer, etc., or a point makeup, such as an eye shadow, a blush, etc., to the skin, various color cosmetics or various kinds of cosmetics have been applied over and over to the skin to adjust width or shading of the cosmetics applied, whereby it has been attempted to create a harmonized texture of the skin though it looks to be uneven at a glance, and thereby produce a good impression against another person.

In addition, makeup may be applied to the skin to correct a degree of gloss or color unevenness, etc., on a whole portion of the skin. However, a human face or body tends to undergo slight change in shade and difference in gloss due to density of blood vessels or capillaries in a subcutaneous tissue, skin spots (deposition of pigment) or dullness owing to exposure to ultraviolet irradiation, or the like depending upon regions thereof. Therefore, even in such a case, it has been required to apply makeup so as to impart a natural impression with a good harmony though it looks to be uneven at a glance.

However, such a complicate precise makeup is hardly created by simple and uniform application of makeup cosmetics, and therefore requires a great deal of time and effort.

On the other hand, in the skin seal described in the Patent Literature 1, the skin can be artificially reproduced by printing the ink layer and the resilient layer on a resin film having releasing properties as the base material by ordinary printing methods, such as screen printing, etc., to form predetermined images thereon. The skin seal is used by attaching the ink layer and the resilient layer to portions of the skin on which scars, etc., to be concealed are present, through the adhesive layer. However, the color shade of the human skin varies between individuals, and therefore even in the same person, conditions of the color shade of the skin are different from each other every region or portion of a human face or body according to spots or dullness caused by exposure to ultraviolet irradiation, etc. In addition, immediately below the skin, a vein extends, and the location of the vein can be recognized from outside as a blue vein. However, when the skin seal having a simple uniform color is attached onto such a skin portion, the vein is concealed thereby so that the portion where the skin seal is attached is readily distinguished from surrounding portions, resulting in giving unnatural impression to another person.

In addition, gloss feel of skin due to a texture or cuticle of the skin varies depending upon a region or portion of a human face or body as well as age even in the same person. For this reason, the difference in appearance between the portion to which the skin seal is attached and the other surrounding portions, in particular, a boundary therebetween, tends to become remarkable. As a result, even though scars on the skin are concealed by the skin seal, it will be difficult to hide such a fact that the skin seal is attached to the skin.

In the Patent Literature 2, when the sheet for makeup is attached to a human skin, it is possible to improve a sense of unity of the sheet with the skin in appearance and the effect of concealing the skin color unevenness, such as spots, etc. However, the Patent Literature 2 is concerned merely with the technology of enhancing the effect of making fine skin unevenness less discernible. Therefore, the sheet for makeup described in the Patent Literature 2 still has much room for improvement in providing natural impression. In addition, as to the sheet for makeup, it has also been required to improve its flexibility that renders the sheet deformable or extensible according to facial expression or motion of a body, as well as its rub fastness that makes the sheet hardly undergo occurrence of breakage or deformation even when rubbing the skin surface with fingers, etc., by which a gloss feel close to that of a human skin can be maintained.

The present invention relates to a process for producing a colored nonwoven fabric that is excellent in flexibility and rub fastness, ability of concealing scars, spots, dullness, etc., and a sense of unity with the skin in appearance or visually when attached thereto, and can exhibit a gloss feel and a transparent feel close to those of a human skin.

The present inventors have noticed that in order to make a physical shape of the surface of a colored nonwoven fabric close to a surface configuration of an actual human skin, upon production of the colored nonwoven fabric, by forming a surface portion of a collector used in an electrospinning process for production thereof on which nanofibers are to be deposited, into an uneven shape, optical characteristics of the resulting colored nonwoven fabric, such as a gloss feel, a transparent feel, etc., owing to the uneven shape of the collector become similar to those of a real human skin, and furthermore the colored nonwoven fabric is improved in flexibility and rub fastness. As a result, the present inventors have found that with such a knowledge, it is possible to obtain a colored nonwoven fabric that is excellent in flexibility and rub fastness, and ability of concealing scars, spots, dullness, etc., and further excellent in a sense of unity with the skin in appearance when attached thereto, and can exhibit a gloss feel and a transparent feel close to those of a human skin.

That is, the present invention relates to a process for producing a colored nonwoven fabric that contains a colorant and nanofibers, including the step of injecting a polymer compound A by an electrospinning method to deposit the nanofibers on a surface of a collector, in which the surface of the collector on which the nanofibers are deposited is at least partially formed into an uneven shape.

In accordance with the present invention, it is possible to provide a process for producing a colored nonwoven fabric that is excellent in flexibility and rub fastness, and ability of concealing scars, spots, dullness, etc., and further excellent in a sense of unity with the skin in appearance when attached thereto, and can exhibit a gloss feel and a transparent feel close to those of a human skin.

[Process for Producing Colored Nonwoven Fabric]

The production process of the present invention is a process for producing a colored nonwoven fabric that contains a colorant and nanofibers, including the step of injecting a polymer compound A which is a constituent component of nanofibers by an electrospinning method to deposit the nanofibers on a surface of a collector, in which the surface of the collector on which the nanofibers are deposited is at least partially formed into an uneven shape.

The term "electrospinning method" as used in the present invention means such a method in which a high voltage is applied to a solution containing a polymer compound or a melt of the polymer compound obtained by heating the polymer compound to inject the spinning liquid and thereby form nanofibers, followed by collecting and depositing the nanofibers on a collector as a counter electrode to obtain a nonwoven fabric thereon. In addition, the term "colored" as used in the present invention means the state of exhibiting a color derived from a colorant which is a concept including a white color and may be either a chromatic color or an achromatic color.

The reason why the aforementioned advantageous effects can be attained by the present invention is considered as follows, though it is not clearly determined yet.

That is, in the production process of the present invention, the colored nonwoven fabric having voids formed by randomly overlapping the nanofibers having a fiber thickness (fiber diameter) of a nanometer-order size on each other is obtained by an electrospinning method. For this reason, intersection points between the respective nanofibers are not adhered to each other, and it is therefore considered that the intersection points can be freely moved against deformation of the whole portion of the colored nonwoven fabric to thereby suppress concentration of a stress in the colored nonwoven fabric, so that the resulting colored nonwoven fabric can exhibit good flexibility that allows the colored nonwoven fabric to deform, or expand and contract without feeling any stress to the skin according to facial expression or motion of a body.

In addition, in the production process of the present invention, the surface of the collector used in the electrospinning method on which the nanofibers are deposited is at least partially formed into an uneven shape. The nanofibers that are deposited on the collector having such an uneven shape by the electrospinning method have a fiber thickness of a nanometer-order size and are continuously connected to each other, so that it is possible to produce the nonwoven fabric while allowing the nanofibers to follow up the uneven shape of the surface of the collector. As a result, the surface of the colored nonwoven fabric is formed into an uneven shape derived from the uneven shape of the collector. Thus, it is considered that the nanofibers are densely deposited in each convex portion of the collector while the nanofibers are sparsely deposited in each concave portion of the collector, whereby it is possible to form a portion corresponding to a skin groove (*Sulcus cutis*) where the nanofibers are relatively densely present and a portion corresponding to a skin hill (*Crista cutis*) where the nanofibers are relatively sparsely present in the colored nonwoven fabric. It is considered that upon deformation, or expansion and contraction of the colored nonwoven fabric, the nanofibers in the skin hill portion where the nanofibers are sparsely present and the friction between the nanofibers is relatively low to render the nanofibers readily movable can be slidingly moved more extensively, so that the colored nonwoven fabric can be improved in flexibility.

In addition, the breakage of the colored nonwoven fabric owing to excessive stress occurring when rubbing the surface of the colored nonwoven fabric tends to be caused from the aforementioned portion corresponding to the skin hill as a starting point. However, since the portion corresponding to the skin hill is surrounded by the portion corresponding to the skin groove where the nanofibers are relatively densely present, it is considered that the breakage of the colored nonwoven fabric occurring at the portion corresponding to the skin hill is prevented from propagating to the other portions corresponding to the skin hill, so that the resulting colored nonwoven fabric can also be improved in rub fastness.

Furthermore, it is considered that according to the present invention, by at least partially forming the surface of the collector on which the nanofibers are deposited, into an uneven shape, it is possible to well control an uneven shape of the surface of the colored nonwoven fabric and therefore control a scattering intensity of light thereon, in particular, by controlling sizes or shapes of the concave and convex portions thereon, it is possible to suppress scattering of light on the surface of the colored nonwoven fabric, enhance a sense of unity of the colored nonwoven fabric with the skin in appearance when attached to the skin, improve ability of concealing scars, spots, dullness, etc., and further achieve a gloss feel and a transparent feel close to those of a human skin.

The colored nonwoven fabric according to the present invention contains at least a colorant and nanofibers. The nanofibers are formed of a polymer compound A.

The colored nonwoven fabric according to the present invention contains the colorant, and therefore has a color derived from the colorant.

From the viewpoint of allowing the colored nonwoven fabric to remain on skin after being attached to the skin without dissolution thereof, and improving flexibility, rub fastness and concealability of the colored nonwoven fabric, as well as from the viewpoint of attaining a good sense of unity with the skin in appearance, a good gloss feel and a good transparent feel of the colored nonwoven fabric, the nanofibers preferably contain at least a water-insoluble polymer compound, and more preferably are constituted of the water-insoluble polymer compound. In the case where the nanofibers contain the water-insoluble polymer compound, the water-insoluble polymer compound functions as a material for forming a skeleton of the nanofibers. For this reason, even after attaching the colored nonwoven fabric to the skin, at least a part of the nanofibers can be maintained in a fiber form without being dissolved in water, such as sweat, etc.

The term "water-insoluble polymer compound" as used in the present specification means a polymer compound whose solubility in water is less than 0.2 g as measured under the environmental conditions of 1 atm and 23° C. by weighing 1 g of the polymer compound, dipping the polymer compound in 10 g of ion-exchanged water and then allowing the polymer compound to stand in the dipped state for 24 hours.

<Polymer Compound A>

The polymer compound A is a raw material of the nanofibers constituting the colored nonwoven fabric.

As the polymer compound A, there may be used either a natural polymer or a synthetic polymer.

The polymer compound A may be either water-soluble or water-insoluble. However, from the viewpoint of allowing the colored nonwoven fabric to remain on a skin after being attached to the skin without dissolution thereof and improving flexibility, rub fastness and concealability of the colored nonwoven fabric, as well as from the viewpoint of attaining a good sense of unity with the skin in appearance, a good gloss feel and a good transparent feel of the colored nonwoven fabric, the polymer compound A preferably contains the water-insoluble polymer compound, and more preferably contains the water-insoluble polymer compound as a main component thereof.

The "main component" as used herein means a component that has a content of not less than 50% by mass on the basis of the whole amount of the polymer compound A.

Meanwhile, the water-insoluble polymer compound used in the present invention may also include such a water-soluble polymer compound that is rendered water-insoluble by subjecting the nanofibers produced therefrom to water-insolubilizing treatment.

Specific examples of the water-insoluble polymer compound include a hydroxy group-containing polymer compound, such as completely saponified polyvinyl alcohol, partially saponified polyvinyl alcohol, polyvinyl butyral, an alkali-soluble cellulose, etc.; a nitrogen-containing functional group-containing polymer compound, e.g., an oxazoline-modified silicone, such as a poly(N-propanoylethyleneimine)-grafted dimethylsiloxane/γ-aminopropylmethylsiloxane copolymer, etc., zein (a main component of a corn protein), etc.; a polyester resin, such as polyethylene terephthalate, polybutylene terephthalate, a polylactic acid (PLA) resin, etc.; an acrylic resin, such as a polyacrylonitrile resin, a polymethacrylic acid resin, etc.; a polystyrene resin; a polyurethane resin; a polyamide resin; a polyimide resin; a polyamideimide resin; and the like. These water-insoluble polymer compounds may be used alone or in combination of any two or more thereof.

Of these water-insoluble polymer compounds, from the viewpoint of allowing the colored nonwoven fabric to remain on a skin after being attached to the skin without dissolution thereof and improving rub fastness of the colored nonwoven fabric, as well as from the viewpoint of attaining a good transparent feel in appearance, preferred is at least one compound selected from the group consisting of the aforementioned hydroxy group-containing polymer compound, the aforementioned nitrogen-containing functional group-containing polymer compound and the aforementioned polyester resin, and more preferred are completely saponified polyvinyl alcohol that can be rendered water-insoluble by water-insolubilizing treatment, partially saponified polyvinyl alcohol that can be rendered water-insoluble by water-insolubilizing treatment by crosslinking, an alkali-soluble cellulose, an oxazoline-modified silicone, such as a poly(N-propanoylethyleneimine)-grafted dimethylsiloxane/γ-aminopropylmethylsiloxane copolymer, etc., zein, a water-soluble polyester resin, and the like. Furthermore, from the viewpoint of being rendered water-insoluble by water-insolubilizing treatment, even more preferred is at least one hydroxy group-containing polymer compound selected from the group consisting of completely saponified polyvinyl alcohol, partially saponified polyvinyl alcohol and an alkali-soluble cellulose, and further even more preferred is at least one compound selected from the group consisting of completely saponified polyvinyl alcohol and an alkali-soluble cellulose.

The polyvinyl alcohols, such as completely saponified polyvinyl alcohol, partially saponified polyvinyl alcohol, etc., not only have a water solubility, but also can be rendered water-insoluble by subjecting them to water-insolubilizing treatment, such as crystallization treatment by heating and drying, or crosslinking treatment using a crosslinking agent, etc.

The alkali-soluble cellulose can be rendered water-insoluble by subjecting it to water-insolubilizing treatment by a method of reducing an alkali concentration thereof by dilution or neutralization, etc., a method of raising an ambient environmental temperature, and the like.

The nanofibers constituting the colored nonwoven fabric according to the present invention may be formed of the aforementioned water-insoluble polymer compound solely, and may also be formed of both of the water-insoluble polymer compound and the water-soluble polymer compound. When the nanofibers contain the water-soluble polymer compound, the resulting colored nonwoven fabric can exhibit good bonding properties and adhesion properties to the skin Upon the use of the colored nonwoven fabric according to the present invention, when applying, for example, a liquid material containing water to the surface of the skin, the water-soluble polymer compound in the nanofibers is dissolved in the liquid material by bringing the colored nonwoven fabric into contact with water, and the thus dissolved water-soluble polymer compound exhibits bonding properties and thereby acts as a binder, so that the colored nonwoven fabric can be improved in adhesion properties to the skin. Furthermore, the water-insoluble polymer compound forms a skeleton of the respective nanofibers, and therefore even after the water-soluble polymer compound is dissolved in the liquid material, a part of the nanofibers can maintain their fibrous configuration.

The term "water-soluble polymer compound" as used in the present specification means a polymer compound whose solubility in water is not less than 0.2 g as measured under the environmental conditions of 1 atm and 23° C. by weighing 1 g of the polymer compound, dipping the polymer compound in 10 g of ion-exchanged water and then allowing the polymer compound to stand in the dipped state for 24 hours.

In the case where the nanofibers are formed of the water-insoluble polymer compound and the water-soluble polymer compound, as the water-soluble polymer compound constituting the nanofibers, there may be mentioned, for example, natural polymers, e.g., mucopolysaccharides, such as pullulan, hyaluronic acid, chondroitin sulfate, poly-γ-glutamic acid, modified corn starch, β-glucan, gluco-oligosaccharides, heparin, keratosulfate, etc., cellulose, pectin, xylan, lignin, glucomannan, galacturonic acid, psyllium seed gum, tamarind seed gum, gum arabic, tragacanth gum, soybean water-soluble polysaccharides, alginic acid, carrageenan, laminaran, agar (agarose), fucoidan, methyl cellulose, hydroxypropyl cellulose, hydroxypropylmethyl cellulose, and the like; and synthetic polymers, such as partially saponified polyvinyl alcohol (when not used in combination with the below-mentioned crosslinking agent), low-saponified polyvinyl alcohol, polyvinyl pyrrolidone (PVP), polyethyleneoxide, sodium polyacrylate, and the like. The polymer compound A may also contain any of these water-soluble polymer compounds in addition to the water-insoluble polymer compound. These water-soluble polymer compounds may be used alone or in combination of any two or more thereof. Of these water-soluble polymer compounds, from the viewpoint of facilitating production of the nanofibers, at least one compound selected from the group consisting of pullulan, partially saponified polyvinyl alcohol, low-saponified polyvinyl alcohol, polyvinyl pyrrolidone and polyethylene oxide is preferably used.

In the case where the polymer compound A contains the water-soluble polymer compound in addition to the water-insoluble polymer compound, the content of the water-soluble polymer compound on the basis of a total content of the water-insoluble polymer compound and the water-soluble polymer compound is preferably not more than 30% by mass and more preferably not more than 25% by mass, and is also preferably not less than 1% by mass and more preferably not less than 10% by mass. By adjusting the content of the water-soluble polymer compound to the aforementioned range, it is possible not only to attain sufficient bonding properties and adhesion properties of the colored nonwoven fabric when attached to the skin, but also to suppress adhesion between the nanofibers and aggregation of the colorant particles.

<Colorant>

In the production process of the present invention, a colorant is used for coloration of the colored nonwoven fabric.

As the aforementioned colorant, from the viewpoint of improving concealability of the colored nonwoven fabric as well as from the viewpoint of applying makeup by attaching the colored nonwoven fabric to the skin, there are preferably used colorants that are capable of coloring the nanofibers to a color range in the vicinity of the complementary color for compensating a skin color of the user, for example, a yellow color, a blue to green color, a violet color, a brown color, etc.

In addition, from the viewpoint of enhancing a sense of unity of the colored nonwoven fabric with the skin in appearance when attached to the skin, there are preferably used those colorants that are capable of coloring the nanofibers to a color close to the skin color of the user. In particular, from the viewpoint of effectively concealing the skin color unevenness (for example, such as facial redness, freckles, bags under eyes, spots, etc.) when attaching the colored nonwoven fabric to the skin, it is preferable to use colorants that are capable of coloring the nanofibers to the skin color of the user.

Examples of white colorants include white pigments, such as titanium oxide, zinc oxide, and the like.

Examples of non-white colorants having a color other than white include inorganic pigments, such as yellow iron oxide, red iron oxide, black iron oxide, carbon blacks, ultramarine blue, Prussian blue, blue titanium oxide, black titanium oxide, chromium oxide, chromium hydroxide, a titanium/titanium oxide sintered product, etc.; organic pigments, such as Red No. 201, Red No. 202, Red No. 226, Yellow No. 401, Blue No. 404, etc.; lake pigments, such as Red No. 104, Red. No. 230, Yellow No. 4, Yellow No. 5, Blue No. 1, etc.; dyes, such as Acid Yellow 1, Acid Orange 7, Food Blue 2, Acid Red 52, etc.; pigments or dyes coated with a resin, such as a polymethacrylic acid ester, etc.; and the like.

As the aforementioned colorant, there may be used nacreous pigments (pearlescent pigments) including inorganic particles, such as titanium oxide-coated mica (titanated mica), red iron oxide-coated mica, bismuth oxychloride, titanium oxide-coated bismuth oxychloride, iron oxide-coated titanated mica, organic pigment-coated titanated mica, silicic acid/titanium-treated mica, titanium oxide-coated talc, silicon dioxide/red iron oxide-treated aluminum, titanium oxide-coated glass powder, etc.; aluminum flakes whose surface is coated with an organic resin, such as polyethylene terephthalate, etc.; and the like.

The aforementioned colorant may be subjected to surface treatments from the viewpoint of improving dispersibility thereof. As the surface treatments, there may be mentioned hydrophobization treatments in which ordinary cosmetic particles are treated with various kinds of hydrophobizing agents. Examples of the hydrophobization treatments include silicone treatment, fatty acid treatment, lauroyl lysine treatment, surfactant treatment, metal soap treatment, fluorine compound treatment, lecithin treatment, nylon treatment, and polymer treatment.

In the case where titanium oxide, zinc oxide, etc., for example, are used as the aforementioned colorant, from the viewpoint of improving dispersibility of the colorant as well as from the viewpoint of improving water resistance and sweat resistance of the resulting colored nonwoven fabric, the surface of titanium oxide, zinc oxide, etc., is preferably subjected to the hydrophobization treatments.

The aforementioned colorants may be used alone or in combination of any two or more thereof according to the color of the colored nonwoven fabric as aimed. From the viewpoint of enhancing a sense of unity of the colored nonwoven fabric with the skin in appearance when attached to the skin, it is preferable to use two or more colorants that are different in color from each other. For example, a red colorant, a yellow colorant and a black colorant have been generally used in combination with each other to adjust the skin color. However, a blue colorant or a white colorant may be further used in combination with these colorants.

The aforementioned colorant is preferably used in the form of polymer particles containing the colorant (hereinafter also referred to as "colorant-containing polymer particles") from the viewpoint of achieving uniform coloration as well as from the viewpoint of improving water resistance of the resulting colored nonwoven fabric. The colorant-containing polymer particles may have any configuration as long as the particles are formed of the colorant and a dispersive polymer. Examples of the configuration of the colorant-containing polymer particles include the particle configuration in which the colorant is coated with the dispersive polymer, the particle configuration in which the colorant is enclosed in the dispersive polymer, the particle configuration in which the colorant is uniformly dispersed in the dispersive polymer, and the particle configuration in which the colorant is exposed onto the surface of the respective polymer particles, etc., as well as a mixture of these particle configurations.

The dispersive polymer constituting the colorant-containing polymer particles as used herein means a polymer with which the colorant can be dispersed in a medium. From the viewpoint of improving dispersibility of the colorant, the dispersive polymer is preferably an ionic group-containing polymer. As the ionic group-containing polymer, there may be used an anionic group-containing anionic polymer and a cationic group-containing cationic polymer.

[Anionic Polymer]

The anionic polymer preferably includes those polymers containing a group that is capable of releasing hydrogen ions upon dissociation thereof to allow the polymer to exhibit acidity, such as a carboxy group (—COOM), a sulfonic acid group ($—SO_3M$), a phosphoric acid group ($—OPO_3M_2$), etc., or those polymers containing an acid group including dissociated ion forms of these groups (such as $—COO^-$, $—SO_3^-$, $—OPO_3^{2-}$ and $—OPO_3^-M$), and the like. In the aforementioned chemical formulae, M is a hydrogen atom, an alkali metal, ammonium or an organic ammonium.

Specific examples of the basic skeleton of the anionic polymer include an acrylic polymer, a polyester, a polyurethane, and the like. Of these polymers, preferred is the acrylic polymer.

More specifically, the anionic polymer is preferably an anionic acrylic polymer containing a constitutional unit derived from an acid group-containing monomer.

As the acid group-containing monomer, preferred is a carboxy group-containing monomer, more preferred is at least one monomer selected from the group consisting of (meth)acrylic acid, crotonic acid, itaconic acid, maleic acid, fumaric acid, citraconic acid and 2-methacryloyloxymethylsuccinic acid, and even more preferred is (meth)acrylic acid.

The term "(meth)acrylic acid" as used herein means at least one compound selected from the group consisting of acrylic acid and methacrylic acid.

The anionic polymer is preferably a polymer containing the constitutional unit derived from the acid group-containing monomer and a constitutional unit derived from a (meth)acrylic acid alkyl ester; more preferably a polymer containing the constitutional unit derived from the acid group-containing monomer, the constitutional unit derived from the (meth)acrylic acid alkyl ester and a constitutional unit derived from a (N-alkyl)(meth)acrylamide; even more preferably a (meth)acrylic acid/(meth)acrylic acid alkyl ester/(N-alkyl)(meth)acrylamide copolymer; and further even more preferably an acrylic acid/acrylic acid alkyl ester/(N-alkyl)acrylamide copolymer.

Examples of commercially available products of the anionic acrylic polymer include ((meth)acrylic acid/(meth) acrylic acid alkyl ester/(N-alkyl)alkyl acrylamide) copolymer AMP, such as "Plascize L-9909B" available from GOO Chemical Co., Ltd., and the like. Examples of the other polymers containing a constitutional unit derived from acrylic acid or methacrylic acid as an anionic group thereof which can be used in the cosmetic applications include "Aniset KB-100H" and "Aniset NF-1000" both available from Osaka Organic Chemical Industry Ltd.; "Ultrahold 8", "Ultrahold Strong" and "Ultrahold Power" all available from BASF; "Plascize L-9900", "Plascize L-9540B", "Plascize L-9600U", "Plascize L-9715", "Plascize L-53", "Plascize L-6330", "Plascize L-6466", "Plascize L-6740B", "Plascize L-53D for Color A" and "Plascize L-75CB" all available from GOO Chemical Co., Ltd.; and the like.

[Cationic Polymer]

The cationic polymer is preferably a polymer containing a cationic group, such as a protonic acid salt of a primary, secondary or tertiary amino group, and a quaternary ammonium group, etc.

As the cationic polymer, there may be mentioned a natural cationic polymer and a synthetic cationic polymer.

Examples of the natural cationic polymer include a polymer obtained from a natural substance by subjecting the substance to treatments such as extraction, refining, etc., and a modified polymer obtained by chemically modifying the polymer, e.g., a polymer containing a glucose residue in a skeleton of the polymer. Specific examples of the natural cationic polymer include cationized guar gum; cationized tara gum; cationized locust bean gum; cationized cellulose; cationized hydroxyalkyl cellulose; cationic starch; and the like.

Examples of the synthetic cationic polymer include polyethyleneimine, polyallylamine or an acid-neutralized product thereof, a polyglycol-polyamine condensate, cationic polyvinyl alcohol, cationic polyvinyl pyrrolidone, a cationic silicone polymer, a 2-(dimethylamino)ethyl methacrylate polymer or an acid-neutralized product thereof, poly(trimethyl-2-methacryloyloxyethyl ammonium chloride), an amine/epichlorohydrin copolymer, an N,N-dimethylaminoethyl methacrylate diethyl sulfuric acid salt/vinyl pyrrolidone copolymer, an N,N-dimethylaminoethyl methacrylate diethyl sulfuric acid salt/N,N-dimethyl acrylamide/dimethacrylic acid polyethylene glycol copolymer, poly(diallyl dimethyl ammonium chloride), a diallyl dimethyl ammonium chloride/acrylamide copolymer, a diallyl dimethyl ammonium chloride/sulfur dioxide copolymer, a diallyl dimethyl ammonium chloride/hydroxyethyl cellulose copolymer, a 1-allyl-3-methyl imidazolium chloride/vinyl pyrrolidone copolymer, an alkylamino (meth)acrylate/vinyl pyrrolidone copolymer, an alkylamino (meth)acrylate/vinyl pyrrolidone/vinyl caprolactam copolymer, a (3-(meth)acrylamido propyl)trimethyl ammonium chloride/vinyl pyrrolidone copolymer, an alkylaminoalkyl acrylamide/alkyl acrylamide/(meth)acrylate/polyethylene glycol (meth)acrylate copolymer, and the like. These synthetic cationic polymers may be used alone or in combination of any two or more thereof.

As commercially available products of the cationic polymer, preferred are those cationic polymers that can be used in the cosmetic applications. Examples of the commercially available products of the cationic polymer include "H.C. Polymer 3M" and "H.C. Polymer 5" both available from Osaka Organic Chemical Industry Ltd.; "Plascize L-514" available from GOO Chemical Co., Ltd.; and the like. Among these cationic polymers, from the viewpoint of improving a sense of unity with the skin in appearance, a gloss feel and a transparent feel of the resulting colored nonwoven fabric, preferred is a cationic silicone polymer.

The cationic silicone polymer is preferably a poly(N-acylalkyleneimine)/organopolysiloxane copolymer containing an organopolysiloxane segment (x), and a poly(N-acylalkyleneimine) segment (y) composed of an alkylene group containing a cationic nitrogen atom bonded to at least one silicon atom of the segment (x) and an N-acylalkyleneimine repeating unit represented by the following general formula (1-1).

(1-1)

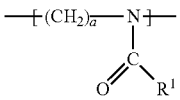

In the formula, $R^1$ is a hydrogen atom, an alkyl group having not less than 1 and not more than 22 carbon atoms, an aryl group having not less than 6 and not more than 22 carbon atoms, or an arylalkyl or alkylaryl group having not less than 7 and not more than 22 carbon atoms; and a is a number of 2 or 3.

In the formula (1-1), $R^1$ is preferably an alkyl group having not less than 1 and not more than 3 carbon atoms and more preferably an ethyl group, and a is preferably 2.

As the organopolysiloxane forming the segment (x), there may be mentioned, for example, a compound represented by the following general formula (1-2):

(1-2)

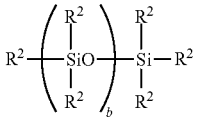

In the formula, $R^2$ is an alkyl group having not less than 1 and not more than 22 carbon atoms, a phenyl group or an alkyl group containing a nitrogen atom, and a plurality of $R^2$ groups may be the same or different from each other, with the proviso that at least one of the $R^2$ groups is an alkyl group containing a cationic nitrogen atom; and b is a number of not less than 100 and not more than 5,000.

The poly(N-acylalkyleneimine)/organopolysiloxane copolymer is preferably a copolymer that is formed by bonding the segment (y) to at least one of the silicon atoms present at a terminal end or side chain of the segment (x) through the alkylene group containing the cationic nitrogen atom.

The mass ratio of the content of the segment (x) to the total content of the segment (x) and the segment (y) [content of segment (x)/total content of segment (x) and segment (y)] in the poly(N-acylalkyleneimine)/organopolysiloxane copolymer is preferably not less than 0.1, more preferably not less than 0.3 and even more preferably not less than 0.4, and is also preferably not more than 0.99, more preferably not more than 0.95, even more preferably not more than 0.9, further even more preferably not more than 0.8 and still further even more preferably not more than 0.7.

In the present specification, the mass ratio [content of segment (x)/total content of segment (x) and segment (y)] means a ratio of a mass (Mx) of the segment (x) to a total amount of the mass (Mx) of the segment (x) and a mass (My) of the segment (y) in the poly(N-acylalkyleneimine)/organopolysiloxane copolymer.

The mass ratio [content of segment (x)/total content of segment (x) and segment (y)] may be calculated from an integration ratio between the alkyl group or the phenyl group in the segment (x) and the methylene group in the segment (y) which may be determined by a nuclear magnetic resonance ($^1$H-NMR) analysis in which the poly(N-acylalkyleneimine)/organopolysiloxane copolymer is dissolved in deuterated chloroform to prepare a 5% by mass solution thereof, and the thus obtained solution is subjected to the NMR analysis.

The weight-average molecular weight of the poly(N-acylalkyleneimine)/organopolysiloxane copolymer is preferably not less than 10,000, more preferably not less than 50,000 and even more preferably not less than 70,000, and is also preferably not more than 1,000,000, more preferably not more than 500,000 and even more preferably not more than 200,000. The weight-average molecular weight of the poly(N-acylalkyleneimine)/organopolysiloxane copolymer may be calculated from the weight-average molecular weight of the organopolysiloxane forming the segment (x) and the aforementioned mass ratio [content of segment (x)/total content of segment (x) and segment (y)].

Examples of the suitable poly(N-acylalkyleneimine)/organopolysiloxane copolymer include a poly(N-formylethyleneimine)/organopolysiloxane copolymer, a poly(N-acetylethyleneimine)/organopolysiloxane copolymer, a poly(N-propionylethyleneimine)/organopolysiloxane copolymer, and the like.

The poly(N-acylalkyleneimine)/organopolysiloxane copolymer may be produced by the method in which the poly(N-acylalkyleneimine) as a ring-opening polymerization product of a cyclic iminoether is reacted with the organopolysiloxane forming the segment (x). More specifically, the poly(N-acylalkyleneimine)/organopolysiloxane copolymer may be produced, for example, by the method described in JP 2011-126978A. The poly(N-acylalkyleneimine)/organopolysiloxane copolymer as the cationic silicone polymer may be used alone or in combination of any two or more kinds thereof.

Incidentally, the weight-average molecular weight of the dispersive polymer other than the aforementioned cationic silicone polymer may be measured by gel permeation chromatography [GPC apparatus: "HLC-8320GPC" available from Tosoh Corporation; columns: "TSKgel Super AWM-H", "TSKgel Super AW3000" and "TSKgel guardcolumn Super AW-H" all available from Tosoh Corporation; flow rate: 0.5 mL/min] using a solution prepared by dissolving phosphoric acid and lithium bromide in N,N-dimethylformamide such that concentrations of phosphoric acid and lithium bromide in the resulting solution are 60 mmol/L and 50 mmol/L, respectively, as an eluent, and using kits of monodisperse polystyrenes having previously known molecular weights [PStQuick B (F-550, F-80, F-10, F-1, A-1000), PStQuick C (F-288, F-40, F-4, A-5000, A-500)] all available from Tosoh Corporation as a reference standard substance.

Upon the aforementioned measurement of the weight-average molecular weight of the polymer, as a sample to be measured, there can be used a solution prepared by mixing 0.1 g of the polymer with 10 mL of the aforementioned eluent in a glass vial, stirring the resulting mixture with a magnetic stirrer at 25° C. for 10 hours, and then subjecting the mixture to filtration treatment through a syringe filter "DISMIC-13HP" (PTFE; 0.2 μm) available from Advantec Co., Ltd.

In the case where the aforementioned colorant is used in the form of pigment particles or colorant-containing polymer particles, it is preferred that the size of the pigment particles or the colorant-containing polymer particles (hereinafter collectively referred to as "colorant particles") is generally similar to the thickness (fiber diameter) of the nanofibers, or smaller than or larger than the thickness of the nanofibers. In the case where the size of the colorant particles is generally similar to or smaller than the thickness of the nanofibers, it is possible to reduce occurrence of the color unevenness of the colored nonwoven fabric on the skin even when the colored nonwoven fabric is of a thin sheet shape. On the other hand, in the case where the size of the colorant particles is larger than the thickness of the nanofibers, it is possible to express and create an uneven shape on the surface of the nanofibers due to the colorant particles. By expressing and creating the uneven shape, irregular reflection of light is caused on the surface of the nanofibers, so that it is possible to improve concealability, a sense of unity with the skin in appearance, a gloss feel and a transparent feel of the colored nonwoven fabric.

In the case where the aforementioned colorant is used in the form of the colorant particles, the volume-average particle size of the colorant particles is preferably not less than 10 nm and more preferably not less than 50 nm, and is also preferably not more than 1,000 nm and more preferably not more than 900 nm.

In addition, in the case where the thickness of the nanofibers lies within the below-mentioned range, the volume-average particle size of the colorant particles relative to the thickness of the nanofibers as calculated in terms of a percentage thereof assuming that the thickness of the nanofibers is regarded as being 100% is preferably not less than 20% and more preferably not less than 30%, and is also preferably not more than 95% and more preferably not more than 90%.

When the volume-average particle size of the colorant particles lies within the aforementioned range, there may be formed such a configuration that the colorant particles are partially enclosed in the nanofibers, and it is therefore possible to suppress aggregation of the colorant particles, reduce occurrence of the color unevenness of the colored nonwoven fabric on the skin even in the case where the colored nonwoven fabric has a thin sheet shape, and thereby enhance a sense of unity of the colored nonwoven fabric with the skin in appearance. Furthermore, in such a case, it is possible to wet the colored nonwoven fabric even with a small amount of a liquid material when attached to the skin.

The volume-average particle size of the colorant particles may be measured by the method described in Examples below.

As the colorant, there may be used not only the colorant particles having an average particle size as small as not more than 1,000 nm, but also a pigment having an average particle size of more than 1,000 nm. Some of white pigments, such as plate-shaped titanium oxide or zinc oxide, or nacreous pigments (pearlescent pigments) may have an average particle size of more than 1,000 nm. These pigments have not only a function as the colorant, but also a function of enhancing diffuse transmission of light, and therefore can also exhibit a function of rendering a boundary between the colored nonwoven fabric attached and its surrounding regions blurred, or a function of suppressing reflection of light on the surface of the colored nonwoven fabric to thereby reduce difference in brightness of light thereon. For this reason, by using these particles in combination with each other, it is possible to reduce the color unevenness of the colored nonwoven fabric on the skin and enhance concealability and a sense of unity of the colored nonwoven fabric with the skin in appearance.

In the case where the pearlescent pigment is used as the aforementioned colorant, a desired amount of the pearlescent pigment can be uniformly applied to the colored nonwoven fabric in a more convenient manner than being put on the colored nonwoven fabric later. In addition, by entangling the pearlescent pigment with the nanofibers, it is possible to exhibit the effect of suppressing falling-off of the pearlescent pigment from the colored nonwoven fabric owing to surface rubbing after attaching the colored nonwoven fabric to the skin. Moreover, since the pearlescent pigment often has a high surface hardness, it is possible to allow the colored nonwoven fabric to exhibit excellent releasability when releasing and removing the colored nonwoven fabric from the collector.

The content of the colorant in the colored nonwoven fabric according to the present invention may vary depending upon the kind of colorant used, and is preferably not less than 1% by mass, more preferably not less than 5% by mass, even more preferably not less than 10% by mass, further even more preferably not less than 15% by mass, still further even more preferably not less than 20% by mass, furthermore preferably not less than 25% by mass, even furthermore preferably not less than 30% by mass and still even furthermore preferably not less than 35% by mass, and is also preferably not more than 60% by mass, more preferably not more than 55% by mass and even more preferably not more than 50% by mass, from the viewpoint of allowing the colorant to exhibit a sufficient coloring power.

The content of the colorant based on the nanofibers in the colored nonwoven fabric according to the present invention may vary depending upon the kind of colorant used. The content of the colorant based on the nanofibers in the colored nonwoven fabric as calculated in terms of a mass percentage thereof assuming that the content of the nanofibers in the colored nonwoven fabric is regarded as being 100% by mass is preferably not less than 50% by mass, more preferably not less than 55% by mass and even more preferably not less than 60% by mass, and is also preferably not more than 110% by mass, more preferably not more than 100% by mass, even more preferably not more than 95% by mass and further even more preferably not more than 90% by mass, from the viewpoint of allowing the colorant to exhibit a sufficient coloring power. That is, the content of the colorant based on the nanofibers in the colored nonwoven fabric according to the present invention as calculated on the basis of 100 parts by mass of the nanofibers in the colored nonwoven fabric is preferably not less than 50 parts by mass, more preferably not less than 55 parts by mass and even more preferably not less than 60 parts by mass, and is also preferably not more than 110 parts by mass, more preferably not more than 100 parts by mass, even more preferably not more than 95 parts by mass and further even more preferably not more than 90 parts by mass, from the same viewpoint as described above.

In the present invention, in the case where the organic pigment, lake pigment or dye is used as the colorant, the colored nonwoven fabric tends to be readily colored. Therefore, in such a case, even when the content of the colorant based on the nanofibers as calculated in terms of a mass percentage thereof assuming that the content of the nanofibers in the colored nonwoven fabric is regarded as being 100% by mass, is as small as about not less than 1% by mass and not more than 10% by mass, that is, the content of the colorant based on the nanofibers in the colored nonwoven fabric as calculated on the basis of 100 parts by mass of the nanofibers in the colored nonwoven fabric is as small as about not less than 1 part by mass and not more than 10 parts by mass, it is possible to obtain the colored nonwoven fabric that is uniformly colored without color unevenness.

The content of the colorant in the colored nonwoven fabric and the content of the colorant based on the nanofibers may be measured as follows. That is, the resulting colored nonwoven fabric is dipped and dissolved in a solvent that is capable of dissolving the colored nonwoven fabric, if required while further applying a mechanical force by means of an ultrasonic cleaning device, etc., thereto, and then filtration of the obtained solution and washing of the filtration residue are repeated to separate solid components therefrom, followed by drying the solid components to measure a mass of the thus dried product by using scales, etc.

(Other Components)

The colored nonwoven fabric according to the present invention may also contain the other components in addition to the nanofibers formed of the colorant and the polymer compound A. Examples of the other components include powder components other than the aforementioned colorant (e.g., resin powders, such as a polyethylene resin powder or a silicone-based resin powder, etc.), as well as a crosslinking agent, a fragrance, a surfactant and an antistatic agent. The crosslinking agent may be used, for example, for the purpose of subjecting the aforementioned partially saponified polyvinyl alcohol to crosslinking reaction to render the polyvinyl alcohol water-insoluble. The other components except for the powder components other than the aforementioned colorant may be contained in the colored nonwoven fabric such that a total content thereof preferably falls within the range of not less than 0.01% by mass and not more than 2% by mass.

(Electrospinning Method)

The production process of the present invention includes the step of injecting at least the polymer compound A by an electrospinning method to deposit the nanofibers on the surface of the collector.

<Collector>

The surface of the collector on which the nanofibers are to be deposited is at least partially formed into an uneven shape from the viewpoint of improving flexibility, rub fastness and concealability of the resulting colored nonwoven fabric as well as from the viewpoint of attaining a good sense of unity with the skin in appearance, a good gloss feel and a good transparent feel of the colored nonwoven fabric. The uneven shape of the surface of the collector is preferably such an uneven shape that imitates a surface configuration of the skin, from the same viewpoint as described above.

The surface configuration of the skin as used herein more specifically indicates visible unevenness owing to wrinkles or pores of the skin, microscopic unevenness of the skin along the skin groove and the skin hill, and the like. Among them, from the same viewpoint as described above, the uneven shape of the collector is preferably a shape imitating the unevenness of the skin along the skin groove and the skin hill.

From the same viewpoint as described above, the collector having such an uneven shape is preferably a collector provided on a surface thereof with a concavo-convex region which is constituted of a plurality of convex portions, and more preferably a collector whose surface is subjected to emboss processing that is called texturing. The textured surface of the collector is so formed that concave portions and convex portions thereon respectively have a smooth surface, and therefore the uneven shape of the collector can be clearly recognized by visual observation even though the difference in level (unevenness) between the concave and convex portions is not so large, so that it is possible to form the uneven shape imitating the surface configuration of the skin on the colored nonwoven fabric.

Meanwhile, in the present invention, it is preferred that the collector is provided on a surface thereof with the aforementioned concave and convex portions. However, the whole shape of the collector is not particularly limited thereto, and may be, for example, either a flat plate shape or a curved shape.

The texture depth (a distance from a highest apex to a lowest valley bottom as viewed in section) is preferably not less than 30 μm and more preferably not less than 70 μm, and is also preferably not more than 300 μm and more preferably not more than 200 μm.

The uneven shape and the texture depth of the collector may be ascertained and measured by the method described in Examples below.

In the present invention, the depth of the uneven shape may be calculated by the following method as described in Examples below. That is, using an industrial microscope "LEXT-OLS5000-SAT" available from Olympus Corporation, a sample to be measured was subjected to 3D measurement by its cross-sectional profile in which the depth as the measurement object is measured at 20 points selected per one collector as the sample to be measured to calculate an average value thereof. Thus, by measuring the depth at 20 points on the collector, even if the collector has a curved shape, the depth of the uneven shape can be calculated without adverse influence of the curved shape.

The material of the collector is not particularly limited, and the collector may be formed of a resin or a metal. Among these materials, from the viewpoint of forming the colored nonwoven fabric that contains a portion corresponding to the skin groove where the nanofibers are relatively densely present and a portion corresponding to the skin hill where the nanofibers are relatively sparsely present, the resin is preferably used. Examples of the resin used for the collector include polyamides, such as nylon 66, etc.; polycarbonates; and the like.

Examples of the collector having a textured surface include molded articles, such as textured artificial leathers, etc., or texturing molds used in the texturing process, and the like. More specifically, as the collector, there may be used, for example, a grain-like artificial leather having a leather pattern used for automobile parts, etc., and a mold used for producing the grain-like artificial leather.

In the case where the mold used for producing the grain-like artificial leather is used as the collector, it is preferred that the information of a texture (unevenness) of a skin portion of the user to which the colored nonwoven fabric is desirably attached is photographed, and the photographed information is analyzed to design a textured shape of the collector so as to reproduce the texture of the skin thereon such that the pitch and height of the unevenness on the resulting colored nonwoven fabric are identical to those on the skin portion to which the colored nonwoven fabric is desirably attached when transferring the colored nonwoven fabric to the skin.

In addition, when using the collector having the textured surface, there can be attained such an effect due to its rub fastness that the uneven shape of the surface of the colored nonwoven fabric which is derived from the uneven shape of the collector is hardly wounded, or the defects produced are less remarkable even when it is wounded. The reason why the uneven shape of the surface of the colored nonwoven fabric is hardly wounded is considered as follows. That is, it is considered that the convex portion of the uneven shape of the surface of the colored nonwoven fabric undergoes point contact and therefore becomes slippery, and further the convex portion is deformable, so that the stress applied thereto can be absorbed and relieved. Moreover, it is considered that since a continuous plane of the colored nonwoven fabric having the uneven shape is located at a position lower than its convex portion, the plane portion of the colored nonwoven fabric tends to be hardly wounded, so that the effect of rendering the defects produced less remarkable can be attained.

Examples of commercially available products of the grain-like artificial leather include "SUPULARE" available from IDEATEX Japan Co., Ltd., "NEOSOFEEL" available from SEIREN Co., Ltd., "ECSAINE" available from TORAY Industries, Inc., and the like.

Examples of commercially available products of the mold used for producing the grain-like artificial leather include "TEXTURE SAMPLE MIJ" series products available from Mold-Tech Japan Co., Ltd., and the like.

As the method of injecting the polymer compound A by an electrospinning method, there may be mentioned a resin solution-type electrospinning method (a) in which a resin solution prepared by dissolving the polymer compound A in a solvent is injected as an injection liquid, and a resin melt-type electrospinning method (b) in which a resin melt prepared by melting the polymer compound A is injected as an injection liquid.

Referring to FIG. 1, there is shown a resin solution-type electrospinning apparatus 30 for implementing the resin solution-type electrospinning method (a). The resin solution-type electrospinning method (a) is implemented by using the apparatus 30 which includes a syringe 31, a high voltage supply 32 and a collector 33. The syringe 31 is equipped with a cylinder 31*a*, a plunger 31*b* and a capillary 31*c*. The capillary 31*c* has an inner diameter of about 10 to 1,000 μm.

The cylinder 31*a* is filled with an injection liquid that contains the polymer compound A as a raw material of the nanofibers, and a solvent, if required together with the colorant. The details of the injection liquid are described hereinbelow. The high voltage supply 32 is, for example, a 10 to 30 kV direct voltage source. A positive electrode 32*a* of the high voltage supply 32 is electrically connected to the injection liquid in the syringe 31, with a negative electrode 32*b* of the high voltage supply 32 being grounded. The collector 33 is disposed such that its surface on which the nanofibers are deposited is formed into an uneven shape, and is grounded. The apparatus 30 shown in FIG. 1 may be operated in the atmosphere.

Meanwhile, although in the apparatus 30 shown in FIG. 1, the nanofibers formed therein are deposited on the collector 33 of a plate shape, a drum-shaped collector may also be used instead of the plate-shaped collector, in which the nanofibers may be deposited on an outer peripheral surface of a rotating drum thereof.

With a voltage applied between the syringe 31 and the collector 33, the plunger 31*b* of the syringe 31 is slowly forced into the cylinder to inject the injection liquid from the tip of the capillary 31*c*. The solvent in the thus injected liquid is allowed to vaporize, and the polymer compound A as a solute is formed into nanofibers and attracted onto the collector 33 while undergoing solidification, and further stretching and deformation, by the difference in electrical potential. In the case where the injection liquid contains the colorant, the colorant is partially incorporated into the polymer compound A in the course of its solidification. At this time, since the surface of the collector 33 has an uneven shape, it is possible to obtain the colored nonwoven fabric that also has a desired uneven shape on the surface thereof. From the principle of the production process, the nanofibers in the thus formed colored nonwoven fabric are respectively constituted of a continuous filament of infinite length.

Figure 2:
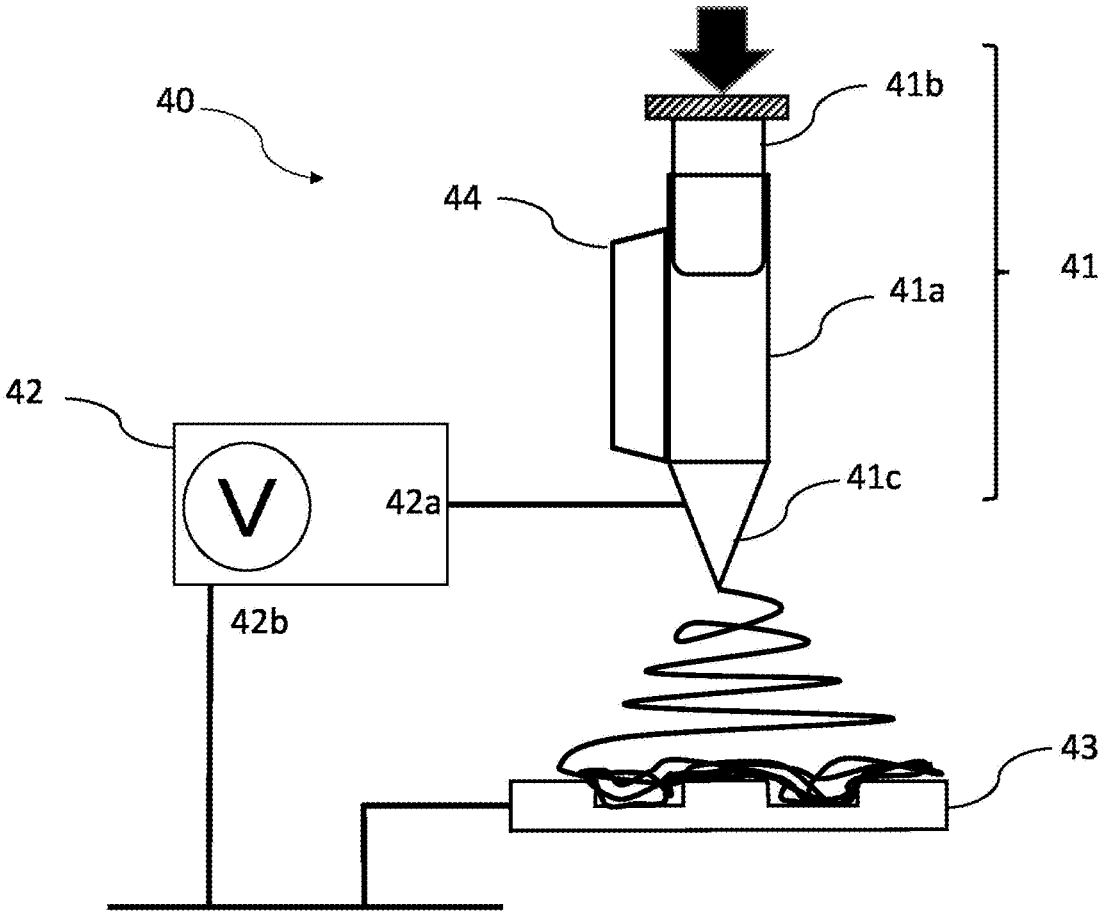
FIG. 2 is a schematic view showing one example of a resin melt-type electrospinning apparatus.

Referring to FIG. 2, there is shown a resin melt-type electrospinning apparatus 40 for implementing the resin melt-type electrospinning method (b). The resin melt-type electrospinning method (b) is implemented by using the apparatus 40 which includes a syringe 41, a high voltage supply 42, a collector 43 and a heater 44. The syringe 41 is equipped with a cylinder 41*a*, a plunger 41*b* and a capillary 41*c*. The capillary 41*c* has an inner diameter of about 10 to 1,000 μm. The cylinder 41*a* is filled with a solid resin that contains the polymer compound A as a raw material of the nanofibers, if required together with the colorant. The high voltage supply 42 is, for example, a 10 to 30 kV direct voltage source. A positive electrode 42*a* of the high voltage supply 42 is electrically connected to the solid resin in the syringe 41, with a negative electrode 42*b* of the high voltage supply 42 being grounded. The collector 43 is disposed such that its surface on which the nanofibers are deposited is formed into an uneven shape, and is grounded. The apparatus 40 shown in FIG. 2 may be operated in the atmosphere.

With a voltage applied between the syringe 41 and the collector 43, the aforementioned solid resin is heated by the heater 44, and melted in the syringe 41. The plunger 41*b* of the syringe 41 is then slowly forced into the cylinder to inject the molten resin as an injection liquid from the tip of the capillary 41*c*. The thus injected molten resin is cooled by release of heat therefrom, and the polymer compound A is formed into nanofibers and attracted onto the collector 43 while undergoing solidification, and further stretching and deformation by the difference in electrical potential. In the case where the solid resin contains the colorant, the solid resin containing the colorant is spun similarly to the nanofibers, and the colorant is partially incorporated into the polymer compound A. At this time, since the surface of the collector 43 has the uneven shape, it is possible to obtain the colored nonwoven fabric that also has a desired uneven shape on the surface thereof. From the principle of the production process, the nanofibers in the thus formed colored nonwoven fabric are respectively constituted of a continuous filament of infinite length.

Incidentally, as the method of incorporating the colorant into the solid resin, there may be used an ordinary method for dispersing a colorant in a thermoplastic resin by heating and kneading, and the like.

The voltage applied in the electrospinning method is preferably not less than 10 kV and more preferably not less than 15 kV, and is also preferably not more than 35 kV and more preferably not more than 30 kV.

The distance between the tip of the capillary of the syringe and the collector is preferably set to not less than 30 mm and more preferably not less than 50 mm, and is also preferably set to not more than 300 mm and more preferably not more than 200 mm.

The average amount of the injection liquid injected is preferably not less than 0.3 mL/imin and more preferably not less than 0.7 mL/min, and is also preferably not more than 2 mL/min and more preferably not more than 1.5 mL/min.

The ambient environmental temperature upon injection of the injection liquid is preferably not lower than 20° C. and more preferably not lower than 25° C., and is also preferably not higher than 45° C. and more preferably not higher than 40° C.

In addition, the ambient environmental humidity upon injection of the injection liquid is preferably not less than 10% RH and more preferably not less than 15% RH, and is also preferably not more than 50% RH and more preferably not more than 45% RH.

(Coloring Method)

Examples of the method of coloring the nanofibers with the colorant in the production process of the present invention include a method of injecting the polymer compound A and the colorant at the same time by an electrospinning method to form the colored nanofibers, and a method of injecting the polymer compound A by an electrospinning method to form uncolored nanofibers, and then coloring the uncolored nanofibers with the colorant. Among these methods, preferred is the method of injecting the polymer compound A and the colorant at the same time by an electrospinning method to form the colored nanofibers (hereinafter also referred to as a "method (i)"), or the method of injecting the polymer compound A by an electrospinning method to form uncolored nanofibers, and then coloring the uncolored nanofibers with the colorant (hereinafter also referred to as a "method (ii)").

(Method (i))

In the case of using the method (i), the production process of the present invention preferably includes the following step 1-1:

Step 1-1: injecting the polymer compound A and the colorant at the same time by an electrospinning method to deposit colorant-containing nanofibers on the surface of the collector, thereby obtaining the colored nonwoven fabric.

[Step 1-1]

In the step 1-1, as the method of injecting the polymer compound A and the colorant at the same time, preferred is the method of injecting the polymer compound A and the colorant from a common capillary.

In the case where the electrospinning method used in the step 1-1 is the resin solution-type electrospinning method (a), the injection liquid containing the polymer compound A and the colorant is used therein. In this case, the content of the colorant based on the content of the polymer compound A in the injection liquid as calculated in terms of a mass ratio thereof assuming that the content of the polymer compound A in the injection liquid is regarded as being 100% by mass, is preferably not less than 0.30, more preferably not less than 0.35 and even more preferably not less than 0.40, and is also preferably not more than 1.10, more preferably not more than 1.00, even more preferably not more than 0.95 and further even more preferably not more than 0.90. That is, the content of the colorant based on the content of the polymer compound A in the injection liquid as calculated on the basis of 100 parts by mass of the content of the polymer compound A in the injection liquid is preferably not less than 30 parts by mass, more preferably not less than 35 parts by mass and even more preferably not less than 40 parts by mass, and is also preferably not more than 110 parts by mass, more preferably not more than 100 parts by mass, even more preferably not more than 95 parts by mass and further even more preferably not more than 90 parts by mass.

The content of the polymer compound A in the injection liquid may vary depending upon a saturation solubility of the resin used, and is preferably not less than 2% by mass, more preferably not less than 3% by mass and even more preferably not less than 4% by mass, and is also preferably not more than 20% by mass, more preferably not more than 15% by mass and even more preferably not more than 10% by mass.

In the present specification, when using two or more kinds of colorants, the content of the colorant as used herein means a total content of the two or more kinds of colorants, and when using two or more kinds of polymer compounds as the polymer compound A, the content of the polymer compound A as used herein means a total content of the two or more kinds of polymer compounds.

In the case of using the injection liquid containing the polymer compound A and the colorant, from the viewpoint of suppressing precipitation or aggregation of the colorant particles when using the aforementioned colorant particles as the colorant to attain a desired color development effect and from the viewpoint of suppressing recrystallization and deposition of dyes in the solvent when using the dyes as the colorant to attain a desired color development effect, as well as from the viewpoint of suppressing clogging of flow paths with the liquid in the electrospinning apparatus, it is preferred that a solution or dispersion containing the colorant is prepared separately from the resin solution containing the polymer compound A, and the thus prepared solution or dispersion containing the colorant is mixed with the resin solution containing the polymer compound A before using them in the electrospinning method to thereby prepare the injection liquid. Since the thus prepared injection liquid is improved in dispersibility of the colorant therein, the nanofibers formed tend to be uniformly colored, and the injection liquid tends to hardly cause clogging of the capillary.

[Preparation of Solution or Dispersion Containing Colorant]

The solution or dispersion containing the colorant which is prepared separately from the resin solution containing the polymer compound A can be obtained by dissolving or dispersing the colorant in a liquid medium. The liquid medium may be appropriately selected and used according to the kind of colorant used. Among them, a volatile liquid medium that can exhibit volatility at a normal temperature (25° C.) under 1 atm is preferably used as the liquid medium. When using such a volatile liquid medium, it is possible to easily remove the liquid medium upon production of the nanofibers by an electrospinning method. From this viewpoint, water or an organic solvent is preferably used as the liquid medium. Examples of the organic solvent include acetone, isoparaffin (light liquid isoparaffin), ethanol, and silicone compounds, such as cyclomethicones, e.g., octamethylcyclotetrasiloxane, decamethylcyclopentasiloxane, etc., dimethicones, e.g., octamethyltrisiloxane, dodecamethylpentasiloxane, etc., methyltrimethicone, etc., and the like. Of these organic solvents, the silicone compounds may be used from the viewpoint of ensuring safety to the skin.

The content of the colorant in the solution or dispersion containing the colorant is preferably not less than 3% by mass, more preferably not less than 5% by mass and even more preferably not less than 10% by mass, and is also preferably not more than 50% by mass, more preferably not more than 40% by mass, even more preferably not more than 30% by mass and further even more preferably not more than 20% by mass, from the viewpoint of satisfying both of the coloring effect for the colored nonwoven fabric and uniformity of the coloration.

When the content of the colorant in the solution or dispersion containing the colorant is controlled to not less than 3% by mass, a sufficient coloring effect for the colored nonwoven fabric can be attained, whereas when the content of the colorant in the solution or dispersion containing the colorant is controlled to not more than 50% by mass, dispersibility of the pigment and solubility of the dyes in the solution or dispersion can be improved, so that it is possible to effectively prevent deterioration in quality of the colored nonwoven fabric owing to aggregation of the pigment particles and deposition of the dyes, etc.

The colorant may be crushed into a predetermined size before preparing the solution or dispersion to control a particle size thereof, or may be dissolved therein in a molecular state.

The solution or dispersion containing the colorant may also contain, in addition to the colorant, a dispersant for enhancing dispersibility of the colorant or a defoaming agent for preventing the solution or dispersion from foaming.

Various kinds of surfactants may be used as the dispersant. Among these surfactants, an anionic surfactant and a nonionic surfactant are preferably used.

Examples of the anionic surfactant include fatty acid metal salts, alkylsulfates, alkylethersulfates, alkylphosphates, alkyletherphosphates and the like. Specific examples of the anionic surfactant include sodium laurylsulfate, sodium polyoxyethylene laurylethersulfate, sodium polyoxyethylene lauryletherphosphate, sodium polyoxyethylene oleyletherphosphate, and the like.

Examples of the nonionic surfactant include polyethylene alkyl ethers, glycerol fatty acid esters, propylene glycol fatty acid esters, fatty acid sorbitan esters, sucrose fatty acid esters, fatty acid mono(di)ethanolamides, polyethylene glycol fatty acid esters, fatty acid polyoxyethylene sorbitol esters, polyoxyethylene hardened castor oil, and the like. Specific examples of the nonionic surfactant include polyoxyethylene octyl dodecyl ether, glycerol monostearate, sorbitan sesquioleate, sucrose fatty acid esters, coconut oil fatty acid diethanolamide, polyethylene glycol monostearate, polyethylene glycol monooleate, polyoxyethylene lauryl ether, polyoxyethylene stearyl ether, polyoxyethylene oleyl ether, polyoxyethylene glycerol monostearate, polyoxyethylene sorbitan monostearate, polyoxyethylene sorbitol tetraoleate, polyoxyethylene hardened castor oil, and the like.

These surfactants may be used alone or in combination of any two or more thereof.

In the case where the solution or dispersion containing the colorant contains the dispersant, the content of the dispersant in the solution or dispersion containing the colorant is preferably not less than 0.1% by mass and more preferably not less than 1% by mass, and is also preferably not more than 10% by mass and more preferably not more than 6% by mass, from the viewpoint of fully enhancing dispersibility of the colorant.

When using the two or more kinds of surfactants in combination with each other as the dispersant, the total content of the surfactants in the solution or dispersion is preferably controlled to the aforementioned range.

The defoaming agent is preferably a silicone-based defoaming agent. Examples of the silicone-based defoaming include dimethylsilicone oil, silicone oil compounds, silicone emulsions, polyether-modified polysiloxane, and fluorosilicone oils.

In the case where the solution or dispersion containing the colorant contains the defoaming agent, the content of the defoaming agent in the solution or dispersion containing the colorant is preferably not less than 0.01% by mass and more preferably not less than 0.1% by mass, and is also preferably not more than 2% by mass, more preferably not more than 1.5% by mass and even more preferably not more than 0.5% by mass, from the viewpoint of suppressing foaming of the solution or dispersion.

Upon preparation of the dispersion containing the colorant, the aforementioned respective components may be mixed with a liquid medium, such as water or an organic solvent, etc., and dispersed in the liquid medium using a disperser while deaggregating the colorant. Examples of the disperser include media mills, such as a ball mill, a bead mill, etc.; and a disper.

As the solution or dispersion containing the colorant, two or more solutions or dispersions which are different in composition from each other may be previously prepared, and such two or more solutions or dispersions may be used at an appropriate mixing ratio according to the aimed color of the colored nonwoven fabric. For example, one of the two or more solutions or dispersions containing the colorant may be prepared in the form of a solution or dispersion that contains only a white pigment (hereinafter also referred to as a "white solution or dispersion"), and the remaining solution(s) or dispersion(s) may be prepared in the form of a solution or dispersion that contains one or more pigments other than the White pigment (hereinafter also referred to as a "non-white solution or dispersion"). From the viewpoint of attaining higher freedom of color matching, it is preferred to prepare the injection liquid for electrospinning by mixing the white solution or dispersion and the one or more non-white solutions or dispersions with the resin solution containing the polymer compound A. For instance, in the case where such a colored nonwoven fabric as colored in skin tone is to be produced, it is preferred that the white solution or dispersion is used in combination with the non-white solution or dispersion.

In addition, in the case where the colorant particles are used in the form of colorant-containing polymer particles, it is preferred that the colorant water dispersion used in the below-mentioned water-based ink for ink-jet printing is used as the dispersion containing the colorant which is used for preparing the injection liquid.

[Preparation of Resin Solution Containing Polymer Compound A]

The resin solution containing the polymer compound A which is used in combination with the solution or dispersion containing the colorant is appropriately selected and used according to the kind of polymer compound A or the kind of solution or dispersion containing the colorant. For example, in the case where the solution or dispersion containing the colorant is in the form of an aqueous solution or water dispersion containing water as a main medium, the resin solution containing the polymer compound A is also preferably in the form of either an aqueous solution or a water-soluble organic solvent solution from the viewpoint of attaining good compatibility therebetween. From the same viewpoint as described above, in the case where the solution or dispersion containing the colorant is a solution or dispersion containing an organic solvent as a main medium, the resin solution containing the polymer compound A is preferably in the form of an organic solvent solution that is compatible with the organic solvent.

In the case where the resin solution containing the polymer compound A contains, for example, a water-insoluble polymer compound as the polymer compound A and water as a medium for the water-insoluble polymer compound, it is possible to use a water-soluble polymer compound that can be rendered water-insoluble by subjecting it to water-insolubilizing treatment after forming the nanofibers, in combination therewith. The use of water as the medium is especially advantageous when producing the nanofibers containing the water-soluble polymer compound in addition to the water-insoluble polymer compound.

For example, in the case of using the aforementioned polyvinyl alcohol or alkali-soluble cellulose, by depositing the nanofibers on the surface of the collector by an electrospinning method and then subjecting the resulting colored nonwoven fabric to water-insolubilizing treatment in which the colored nonwoven fabric is heated, rinsed with water or dried to remove a neutralizing agent therefrom, it is possible to obtain the colored nonwoven fabric that contains the nanofibers containing a water-insoluble polymer compound formed of the polyvinyl alcohol or alkali-soluble cellulose.

The preferred heating conditions for the water-insolubilizing treatment include a heating temperature of 20 to 200° C. and a heating time of 1 to 200 minutes.

In the case of using the water-soluble polymer compound that can be rendered water-insoluble after deposition or formation of the nanofibers, there may also be used a mixed solution prepared by dispersing and dissolving the water-soluble polymer compound that can be subsequently rendered water-insoluble and another water-soluble polymer compound commonly in the same solvent. In this case, as the solvent, there may be used water as described above. In addition, a mixed solvent containing water and a water-soluble organic solvent may also be used in place of the water.

As the other example of the resin solution containing the polymer compound A, there may be mentioned a solution that contains a water-soluble polymer compound and a water-insoluble polymer compound that can be dissolved in an organic solvent compatible with water, and a mixed solvent containing water and the organic solvent. Examples of the combination of the water-insoluble polymer compound and the organic solvent which may be used in the resin solution include a combination of an oxazoline-modified silicone with ethanol or methanol, and a combination of a zein with ethanol or acetone.

As the still other example of the resin solution containing the polymer compound A, there may be mentioned a solution prepared by dissolving a water-soluble polymer compound that can be dissolved in water and an organic solvent and a water-insoluble polymer compound that can be dissolved in the organic solvent, in the organic solvent. Examples of the combination of the water-soluble polymer compound and the water-insoluble polymer compound which can be used in the resin solution include a combination of hydroxypropyl cellulose with polyvinyl butyral.

Even though the resin solution containing the polymer compound A is any type of the aforementioned solutions, the content of the polymer compound A in the resin solution (in the case where two or more kinds of polymer compounds are used as the polymer compound A, it means a total content of the two or more polymer compounds as described above) may vary depending upon the saturation solubility of the resin used, and is preferably not less than 3% by mass, more preferably not less than 5% by mass and even more preferably not less than 10% by mass, and is also preferably not more than 35% by mass, more preferably not more than 25% by mass and even more preferably not more than 20% by mass.

When the resin solution containing the polymer compound A and the solution or dispersion containing the colorant are mixed with each other to prepare the injection liquid for electrospinning, in the case where the content of the polymer compound A in the resin solution containing the polymer compound A and the content of the colorant in the solution or dispersion containing the colorant respectively fall within the aforementioned ranges, the content of the resin solution containing the polymer compound A in the whole amount of the injection liquid is preferably not less than 40% by mass, more preferably not less than 50% by mass and even more preferably not less than 55% by mass, and is also preferably not more than 95% by mass, more preferably not more than 93% by mass and even more preferably not more than 90% by mass.

(Method (ii))

In the case where the method (ii) of injecting the polymer compound A by an electrospinning method to form uncolored nanofibers and then coloring the uncolored nanofibers with the colorant is used as the method for coloring the nanofibers, examples of the method of applying the colorant to the nanofibers include an ink-jet printing method; and an analog printing method, such as gravure printing, flexographic printing, offset printing, screen printing, etc. Of these printing methods, from the viewpoint of improving a sense of unity with the skin in appearance, a gloss feel and a transparent feel of the resulting colored nonwoven fabric by the coloration, preferred is an ink-jet printing method.

In the ink-jet printing method, droplets containing the colorant (ink) are directly applied onto a material to be printed while keeping a printing apparatus, etc., in non-contact with the material. Therefore, the ink-jet printing method is capable of applying the colorant to the preliminarily prepared uncolored nonwoven fabric without any physical damage thereto to thereby enable production of the colored nonwoven fabric.

In addition, since the amount of the colorant applied can be controlled independently of the amount of the polymer compound A injected, it is possible to broaden a color region of the coloration which can be achieved by the colored nonwoven fabric. Furthermore, since the colorant having a different solubility from that of the polymer compound A can be used in the ink-jet printing method, it is possible to increase the degree of freedom of designing of the colorant and facilitate control of storage stability of the injection liquid.

As the method of applying the ink-jet printing method to the aforementioned coloration, there may be mentioned the method of applying an ink containing the colorant to the preliminarily prepared uncolored nonwoven fabric by an ink-jet printing method, and the method of preliminarily applying an ink containing the colorant onto the uneven shape of the surface of the collector by an ink-jet printing method, and then depositing the uncolored nanofibers on the uneven surface of the collector to which the colorant has been applied.

In the case where the preliminarily prepared uncolored nonwoven fabric is subjected to ink-jet printing, the ink applied thereto is retained in a void layer of the nonwoven fabric which is formed by the nanofibers in the nonwoven fabric, by a capillary attraction force. For this reason, the ink has a dot shape close to a true circle, and therefore can also be prevented from suffering from occurrence of intercolor bleeding (color mixture). In this case, the image quality of the resulting colored nonwoven fabric is similar to that of an analog printed material, so that a contour of the colored nonwoven fabric attached is obscured mildly, whereby it is possible to improve a sense of unity with the skin in appearance, a gloss feel and a transparent feel of the resulting colored nonwoven fabric, and obtain makeup images capable of imparting gentle impression.

On the other hand, in the method of preliminarily applying the colorant to the uneven shape of the collector by an ink-jet printing method and then depositing the nanofibers on the uneven-shaped surface of the collector to which the colorant has been applied, since the ink is preliminarily filled in the concavo-convex portions of the surface of the collector, it is possible to form an image pattern that can be hardly designed by an ordinary ink-jet printing method, such as those image patterns having not only a true circle shape, but also a square shape, a triangular shape, a honeycomb shape constituted of continuously arranged hexagonal shapes, etc., on the colored nonwoven fabric. In this case, the resulting colored nonwoven fabric has such an image quality as capable of producing makeup images imparting an intellectual virtual reality-like impression whose contour is sharply accentuated like those obtained by a line-drawing digital device, such as a display, etc.

In the case of using the method (ii) in the production process of the present invention, from the viewpoint of improving a sense of unity with the skin in appearance, a gloss feel and a transparent feel of the resulting colored nonwoven fabric, the production process of the present invention preferably includes the following step 2-1 and step 2-2.

Step 2-1: injecting the polymer compound A by an electrospinning method to deposit the nanofibers on the surface of the collector, thereby obtaining an uncolored nonwoven fabric; and Step 2-2: applying the colorant to the uncolored nonwoven fabric obtained in the step 2-1 by an ink-jet printing method to obtain the colored nonwoven fabric.

[Step 2-1]

In the electrospinning method of the step 2-1, there may be used any of the aforementioned resin solution-type electrospinning apparatus and resin melt-type electrospinning apparatus.

In the case of using the resin solution-type electrospinning apparatus, it is preferred that when injecting the polymer compound A, the aforementioned resin solution containing the polymer compound A is used as the injection liquid containing the polymer compound A.

The content of the polymer compound A in the injection liquid used in the step 2-1 (in the case where two or more kinds of polymer compounds are used as the polymer compound A, it means a total content of the two or more polymer compounds as described previously) may vary depending upon the saturation solubility of the resin used, and is preferably not less than 2% by mass, more preferably not less than 3% by mass and even more preferably not less than 4% by mass, and is also preferably not more than 20% by mass, more preferably not more than 15% by mass and even more preferably not more than 10% by mass.

[Step 2-2]

The colorant used in the ink-jet printing method of the step 2-2 is preferably used in the form of a water-based ink whose viscosity is controlled so as to render raw materials used for ordinary cosmetics ejectable by ink-jetting, for example, may be controlled to not more than 20 mPa·s. The term "water-based" as used herein means that water has a largest content among components of a medium contained in the water-based ink.

When applying the colorant by the ink-jet printing method, the components other than the colorant may be respectively applied in a necessary amount to a necessary position. The application of the other components is also preferably used in the case where functional chemicals are driven into the void layer of the colored nonwoven fabric to retain the chemicals therein or in the case where the nanofibers are dissolved or swelled to control the shape or thickness of the nanofibers in the colored nonwoven fabric.

The method of ejecting the ink which can be used in the ink-jet printing method is not particularly limited, and may be any of an electro-mechanical conversion method such as a piezoelectric method, etc., an electro-thermal conversion method, such as a thermal method, etc., and the like.

[Water-Based Ink for Ink-Jet Printing]

The water-based ink for ink-jet printing contains a pigment water dispersion, a dye aqueous solution, or a colorant water dispersion prepared by dispersing a colorant, such as a pigment or a dye, with a water-dispersive polymer, and may be produced by adding an organic solvent, water and various additives thereto.

The term "water-dispersive polymer" as used in the present specification means a polymer with which the colorant can be dispersed in a water-based medium. From the viewpoint of improving dispersibility of the colorant, the water-dispersive polymer used in the ink is preferably an ionic group-containing polymer, more preferably an anionic group-containing anionic polymer and a cationic group-containing cationic polymer. Examples of the anionic group-containing anionic polymer and the cationic group-containing cationic polymer include the same polymers as illustrated above as to the dispersive polymer.

The content of the colorant in the water-based ink is preferably not less than 1% by mass, more preferably not less than 2% by mass, even more preferably not less than 3% by mass and further even more preferably not less than 4% by mass, and is also preferably not more than 20% by mass, more preferably not more than 15% by mass, even more preferably not more than 10% by mass and further even more preferably not more than 8% by mass, from the viewpoint of improving storage stability and ejection durability of the water-based ink as well as from the viewpoint of enhancing optical density of the ink on the colored nonwoven fabric upon printing.

The content of water in the water-based ink is preferably not less than 50% by mass, more preferably not less than 60% by mass, even more preferably not less than 75% by mass and further even more preferably not less than 80% by mass, and is also preferably not more than 95% by mass, more preferably not more than 94% by mass and even more preferably not more than 93% by mass, from the viewpoint of improving storage stability and ejection durability of the water-based ink.

The static surface tension of the water-based ink as measured at 20° C. is preferably not less than 25 mN/m, more preferably not less than 30 mN/m and even more preferably not less than 32 mN/m, and is also preferably not more than 45 mN/m, more preferably not more than 40 mN/m and even more preferably not more than 38 mN/m, from the viewpoint of improving ejection durability of the water-based ink.

The viscosity of the water-based ink as measured at 35° C. is preferably not less than 1 mPa·s, more preferably not less than 1.5 mPa·s and even more preferably not less than 2 mPa·s, and is also preferably not more than 10 mPa·s, more preferably not more than 7 mPa·s and even more preferably not more than 4 mPa·s, from the viewpoint of improving ejection durability of the water-based ink.

The static surface tension of the water-based ink as measured at 20° C. and the viscosity of the water-based ink as measured at 35° C. may be measured by the respective methods described in Examples below.

The aforementioned water-based ink may also contain various additives that are usually used in water-based inks from the viewpoint of controlling physical properties of the ink. Examples of the additives include a wetting agent, a penetrant, a dispersant, such as a surfactant, etc., a viscosity controller, such as hydroxypropyl cellulose, hydroxyethyl cellulose, polyvinyl alcohol, etc., a defoaming agent, such as a silicone oil, etc., a mildew-proof agent, a rust preventive, and the like.

Examples of the wetting agent and the penetrant include polyhydric alcohols and ethers or acetates of the polyhydric alcohols, such as ethylene glycol, propylene glycol (1,2-propanediol), 1,2-hexanediol, diethylene glycol, triethylene glycol, polyethylene glycol, glycerin, trimethylol propane, diethylene glycol diethyl ether, etc. Of these wetting agents and penetrants, preferred are propylene glycol (1,2-propanediol), 1,2-hexanediol, polyethylene glycol, glycerin, triethylene glycol and trimethylol propane.

In addition, the polyhydric alcohols may also be used in the form of an alkyleneoxide adduct thereof. Examples of the preferred alkyleneoxide adduct of the polyhydric alcohols include a glycerin-modified ethyleneoxide adduct.

Examples of the surfactant include a nonionic surfactant, such as an ethyleneoxide adduct of acetylenediol, a polyoxyethylene alkyl ether, etc., and the like.

The volume-average particle size of the colorant particles in the aforementioned water-based ink in the case of using a non-white colorant as the colorant is preferably not less than 30 nm, more preferably not less than 50 nm and even more preferably not less than 60 nm, and is also preferably not more than 250 nm, more preferably not more than 200 nm and even more preferably not more than 180 nm, from the viewpoint of suppressing clogging of nozzles to thereby improve ejection durability of the ink as well as from the viewpoint of improving dispersion stability of the colorant particles.

The volume-average particle size of the colorant particles in the aforementioned water-based ink in the case of using a white colorant as the colorant is preferably not less than 150 nm, more preferably not less than 240 nm and even more preferably not less than 290 nm, and is also preferably not more than 1,000 nm, more preferably not more than 500 nm, even more preferably not more than 350 nm and further even more preferably not more than 330 nm, from the same viewpoint as described above.

The volume-average particle size of the colorant particles in the water-based ink may be measured by the method described in Examples below.

[Production of Colorant Water Dispersion]

The aforementioned colorant water dispersion may be produced by the method of dispersing the colorant particles in water. In the case where the colorant dispersed with the water-dispersive polymer is used as the colorant particles, the process for producing the colorant water dispersion preferably includes the following step I and step II, though it is not necessarily limited thereto.

Step I: subjecting a colorant mixture containing water, the colorant, the water-dispersive polymer and an organic solvent to dispersion treatment to obtain a colorant dispersion liquid; and Step II: removing the organic solvent from the colorant dispersion liquid obtained in the step I to obtain the colorant water dispersion.

[Step I]

The step I is the step of subjecting a colorant mixture containing water, the colorant, the water-dispersive polymer and an organic solvent to dispersion treatment to obtain a colorant dispersion liquid.

The content of the water-dispersive polymer in the colorant mixture is preferably not less than 1% by mass, more preferably not less than 3% by mass and even more preferably not less than 5% by mass, and is also preferably not more than 15% by mass, more preferably not more than 12% by mass and even more preferably not more than 10% by mass, from the viewpoint of improving dispersion stability of the colorant water dispersion and storage stability and ejection durability of the resulting water-based ink.

The mass ratio of the content of the colorant to the content of the water-dispersive polymer [colorant/water-dispersive polymer] in the colorant mixture is preferably not less than 1, more preferably not less than 1.5 and even more preferably not less than 2, and is also preferably not more than 4, more preferably not more than 3.5 and even more preferably not more than 3, from the viewpoint of improving dispersion stability of the colorant water dispersion and storage stability and ejection durability of the resulting water-based ink.

The organic solvent used in the step I preferably has high affinity to the water-dispersive polymer and good wettability to the colorant. As the organic solvent, preferred are organic solvents having 2 to 8 carbon atoms, such as aliphatic alcohols, ketones, ethers, esters and the like. Examples of the aliphatic alcohols include n-butanol, tertiary butanol, isobutanol, diacetone alcohol, and the like. Examples of the ketones include methyl ethyl ketone, diethyl ketone, methyl isobutyl ketone, and the like. Examples of the ethers include dibutyl ether, tetrahydrofuran, dioxane, and the like. Of these organic solvents, from the viewpoint of improving wettability to the colorant and adsorptivity of the water-dispersive polymer upon the coloration as well as from the viewpoint of improving safety problems owing to the residual organic solvent when attached to the skin, preferred are ethanol and isopropanol, and more preferred is ethanol.

The content of the organic solvent in the colorant mixture is preferably not less than 10% by mass, more preferably not less than 20% by mass and even more preferably not less than 25% by mass, and is also preferably not more than 50% by mass, more preferably not more than 45% by mass and even more preferably not more than 40% by mass, from the viewpoint of improving wettability of the colorant and adsorptivity of the water-dispersive polymer to the colorant. Meanwhile, in the case where two or more organic solvents are contained in the colorant mixture, the total amount of the two or more organic solvents is calculated as the amount of the aforementioned organic solvent, and it is hereinafter defined in the same way.

The mass ratio of the content of the water-dispersive polymer to the content of the organic solvent [water-dispersive polymer/organic solvent] in the colorant mixture is preferably not less than 0.10, more preferably not less than 0.15 and even more preferably not less than 0.20, and is also preferably not more than 0.60, more preferably not more than 0.50 and even more preferably not more than 0.40, from the viewpoint of improving wettability of the colorant and adsorptivity of the polymer to the colorant.

The total content of water and the organic solvent in the colorant mixture is preferably not less than 50% by mass, more preferably not less than 55% by mass and even more preferably not less than 60% by mass, and is also preferably not more than 85% by mass, more preferably not more than 80% by mass and even more preferably not more than 75% by mass, from the viewpoint of improving dispersion stability of the colorant water dispersion as well as from the viewpoint of enhancing productivity of the colorant water dispersion.

The mass ratio of the content of the organic solvent to the content of water [organic solvent/water] in the colorant mixture is preferably not less than 0.20, more preferably not less than 0.40 and even more preferably not less than 0.60, and is also preferably not more than 1, more preferably not more than 0.90 and even more preferably not more than 0.80, from the viewpoint of controlling wettability of the colorant to thereby accelerate dispersion of the colorant as well as from the viewpoint of improving adsorptivity of the water-dispersive polymer to the colorant.

In the case where the ionic group-containing polymer is used as the water-dispersive polymer, from the viewpoint of improving dispersion stability of the colorant water dispersion as well as storage stability and ejection durability of the resulting water-based ink, the ionic groups contained in the water-dispersive polymer are preferably neutralized in the step I using a neutralizing agent. When using the neutralizing agent, the ionic groups contained in the water-dispersive polymer are neutralized such that the pH value of the resulting colorant water dispersion preferably falls within the range of from 7 to 11.

In the case where the ionic groups contained in the water-dispersive polymer are anionic groups, examples of the neutralizing agent include hydroxides of alkali metals; volatile bases, such as ammonia, etc.; and organic amines, such as methylamine, dimethylamine, trimethylamine, ethylamine, diethylamine, triethylamine, triethanolamine, tributylamine, etc. Of these neutralizing agents, from the viewpoint of improving dispersion stability of the colorant water dispersion as well as storage stability and ejection durability of the resulting water-based ink, preferred are hydroxides of alkali metals and volatile bases, and more preferred are hydroxides of alkali metals. As the hydroxides of alkali metals, preferred is sodium hydroxide.

The neutralizing agent is preferably used in the form of an aqueous neutralizing agent solution from the viewpoint of sufficiently accelerating the neutralization. These neutralizing agents may be used alone or in the form of a mixture of any two or more thereof.

In the case where a hydrophobic pigment, such as a hydrophobized titanium oxide, hydrophobized zinc oxide, etc., is used as the colorant, it is preferred that the step I preferably includes the following steps I-1 and I-2 in which a cationic silicone polymer and an anionic polymer are used in combination with each other as the water-dispersive polymer.

Step I-1: suspending the hydrophobized hydrophobic pigment using the cationic silicone polymer to obtain a suspension of the hydrophobic pigment; and Step I-2: adding the anionic polymer to the suspension of the hydrophobic pigment obtained in the step I-1 to obtain a colorant mixture, and then subjecting the colorant mixture to dispersion treatment to obtain a colorant dispersion liquid.

By conducting the step I-1, a hydrophobic silicone moiety of the cationic silicone polymer is adsorbed onto the surface of the hydrophobic pigment, whereas a hydrophilic cationic moiety of the cationic silicone polymer is oriented to the side of the medium, so that the colorant particles can be suspended in such a stable state that they possess a positive zeta potential.

Then, by adding the anionic polymer in the step I-2, the anionic polymer is adsorbed onto the cationic groups of the cationic silicone polymer adsorbed onto the hydrophobic pigment to thereby disperse the colorant particles in such a state that they possess a negative zeta potential, whereby it is possible to obtain a stable dispersion even when using the hydrophobic pigment.

In the case where the non-white colorant is used in the step I, the volume-average particle size of the colorant particles in the colorant dispersion liquid obtained after the dispersion treatment is preferably not less than 30 nm, more preferably not less than 50 nm and even more preferably not less than 60 nm, and is also preferably not more than 250 nm, more preferably not more than 200 nm and even more preferably not more than 180 nm.

In the case where the white colorant is used in the step I, the volume-average particle size of the colorant particles in the colorant dispersion liquid obtained after the dispersion treatment is preferably not less than 150 nm, more preferably not less than 240 nm and even more preferably not less than 290 nm, and is also preferably not more than 1,000 nm, more preferably not more than 500 nm, even more preferably not more than 350 nm and further even more preferably not more than 330 nm, from the viewpoint of improving dispersion stability of the white colorant (for example, such as titanium oxide), suppressing foaming of the dispersion liquid and improving defoaming properties thereof.

The volume-average particle size of the colorant particles in the colorant dispersion liquid may be measured by the method described in Examples below.

The colorant particles may be atomized into fine particles having a desired volume-average particle size only by a substantial dispersion treatment by applying a shear stress thereto. However, it is preferred that the colorant mixture is first subjected to a preliminary dispersion treatment, and then further to the substantial dispersion treatment so as to control the volume-average particle size of the obtained colorant particles to a desired value.

In the preliminary dispersion treatment, there may be used ordinary mixing or stirring devices such as an anchor blade, a disper blade, etc. Of these devices, preferred are high-speed stirring mixers, such as "Ultra Disper" (tradename) available from Asada Iron Works Co., Ltd., "Ebara Milder" (tradename) available from Ebara Corporation, "TK Homomixer" (tradename) and "TK ROBOMIX" (tradename) both available from Primix Co., Ltd., and the like.

As a means for applying a shear stress in the substantial dispersion treatment, there may be used, for example, kneading machines, such as roll mills, kneaders, extruders, etc., high-pressure homogenizers, such as "MICROFLUIDIZER" (tradename) available from Microfluidics Corporation, etc., and media-type dispersers, such as paint shakers, beads mills, etc. Examples of the commercially available media-type dispersers include "Ultra Apex Mill" (tradename) available from Kotobuki Industries Co., Ltd., "Pico Mill" (tradename) available from Asada Iron Works Co., Ltd., and the like. These devices may be used in combination of any two or more thereof. Among these devices, the high-pressure homogenizers are preferably used from the viewpoint of reducing a particle size of the colorant.

In the case where the substantial dispersion treatment is conducted using the high-pressure homogenizer, the particle size of the colorant can be adjusted to a desired value by controlling the treating pressure and the number of passes through the homogenizer in the dispersion treatment.

The treating pressure used in the substantial dispersion treatment is preferably not less than 60 MPa, more preferably not less than 100 MPa and even more preferably not less than 150 MPa, and is also preferably not more than 250 MPa, more preferably not more than 200 MPa and even more preferably not more than 180 MPa.

Also, the number of passes through the homogenizer used in the dispersion treatment is preferably not less than 3, more preferably not less than 10 and even more preferably not less than 15, and is also preferably not more than 30, more preferably not more than 25 and even more preferably not more than 20.

[Step II]

The step II is the step of removing the organic solvent from the colorant dispersion liquid obtained in the step I, thereby obtaining the colorant water dispersion.

In the step II, the mass ratio of the content of the organic solvent to the content of water [organic solvent/water] in the colorant dispersion liquid that is subjected to removal of the organic solvent therefrom is preferably not less than 0.10, more preferably not less than 0.15 and even more preferably not less than 0.20, and is also preferably not more than 0.50, more preferably not more than 0.40 and even more preferably not more than 0.30, from the viewpoint of attaining progressive dispersion of the colorant by improving wettability of the colorant as well as from the viewpoint of improving adsorptivity of the polymer to the colorant.

The method of removing the organic solvent is not particularly limited, and may be conducted by any suitable conventionally known methods. Incidentally, a part of water contained in the colorant dispersion liquid may be removed together with the organic solvent at the same time.

The temperature and time used upon removal of the organic solvent may be appropriately selected according to the kind of organic solvent to be removed.

The organic solvent is preferably substantially completely removed from the aforementioned colorant water dispersion. However, the residual organic solvent may be present in the colorant water dispersion unless the objects and advantageous effects of the present invention are adversely affected by the residual organic solvent. The content of the residual organic solvent in the colorant water dispersion is preferably not more than 0.1% by mass and more preferably not more than 0.01% by mass.

The concentration of non-volatile components in the colorant water dispersion (solid content of the colorant water dispersion) is preferably not less than 10% by mass, more preferably not less than 15% by mass and even more preferably not less than 18% by mass, and is also preferably not more than 30% by mass, more preferably not more than 25% by mass and even more preferably not more than 22% by mass, from the viewpoint of improving dispersion stability of the colorant water dispersion as well as from the viewpoint of facilitating production of the water-based ink. The solid content may be measured by the method described in Examples below.

[Step 3]

In the present invention, from the viewpoint of enhancing a sense of unity of the colored nonwoven fabric with the skin in appearance, and suitably controlling a gloss feel and a transparent feel of the colored nonwoven fabric, a colorant may be further applied to the resulting colored nonwoven fabric by an ink-jet printing method. More specifically, the production process of the present invention may further include the following step 3. The ink-jet printing method used in the step 3 may be conducted using the aforementioned colorant in the form of a water-based ink by the same method as in the step 2-2. By conducting the step 3, it is possible to make suitable adjustment between the skin color of the user and the color of the colored nonwoven fabric when attaching the colored nonwoven fabric to the skin, so that the colored nonwoven fabric can also be improved in concealability against scars, etc. In addition, in the step 3, it is also possible to apply decoration or makeup, such as design patterns, characters, tattoos, etc., to the colored nonwoven fabric. Incidentally, the step 3 is repeatedly carried out plural times from the viewpoint of applying different kinds of decoration or makeup to the colored nonwoven fabric.

Step 3: applying a colorant to the resulting colored nonwoven fabric by an ink-jet printing method to obtain a colored nonwoven fabric which is further colored with the colorant.

(Colored Nonwoven Fabric)

In the colored nonwoven fabric according to the present invention, the nanofibers are entangled with each other, whereby the colored nonwoven fabric is capable of maintaining a sheet-like configuration by itself.

The thickness of the respective nanofibers in the colored nonwoven fabric according to the present invention as represented by an equivalent circle diameter thereof is preferably not less than 10 nm, more preferably not less than 50 nm and even more preferably not less than 80 nm, and is also preferably not more than 3,000 nm, more preferably not more than 1,000 nm and even more preferably not more than 700 nm. The thickness of the respective nanofibers may be measured, for example, by observing the nanofibers by a scanning electron microscope (SEM) at a magnification of 10,000 times, in which optional 10 nanofibers are selected from those in the colored nonwoven fabric, and a line perpendicular to a longitudinal direction of the respective nanofibers is drawn to directly read a fiber diameter of the nanofiber.

The configuration of the colored nonwoven fabric according to the present invention is preferably a thin sheet-like shape from the viewpoint of attaching the colored nonwoven fabric to the skin of the user upon use. From the viewpoint of improving handling properties of the colored nonwoven fabric when attaching the colored nonwoven fabric to the skin of the user upon use, the thickness of the colored nonwoven fabric is preferably not less than 50 nm, more preferably not less than 500 nm, even more preferably not less than 1 μm and further even more preferably not less than 5 μm, and is also preferably not more than 1 mm, more preferably not more than 500 μm, even more preferably not more than 300 μm and further even more preferably not more than 100 μm. By adjusting the thickness of the colored nonwoven fabric to the aforementioned range, a difference in level between the edge portion of the colored nonwoven fabric and the skin of the user tends to be hardly caused, so that a sense of unity of the colored nonwoven fabric with the skin of the user in appearance can be enhanced. In addition, when attaching the colored nonwoven fabric onto fine uneven portions on the skin, for example, skin portions of fine wrinkles or pores, it is possible to conceal these fine wrinkles or pores. From the same viewpoint as described above, the basis weight of the colored nonwoven fabric is preferably controlled to the range of not less than 0.01 $g/m^2$ and more preferably not less than 0.1 $g/m^2$, and also preferably controlled to the range of not more than 100 $g/m^2$ and more preferably not more than 50 $g/m^2$.

The thickness of the colored nonwoven fabric may be measured by the method described in Examples below.

[Substrate Sheet]

The colored nonwoven fabric according to the present invention may have either a single layer structure that is formed of the colorant and the nanofibers, or a multi-layer structure that is formed by laminating the colored nonwoven fabric containing the colorant and the nanofibers, and the other sheet(s) on each other. As the other sheet(s) which may be used in combination with the colored nonwoven fabric, for example, from the viewpoint of supporting the colored nonwoven fabric prior to its use as well as from the viewpoint of enhancing handling properties thereof, there may be used a substrate sheet. In the case where the colored nonwoven fabric has a small thickness, the colored nonwoven fabric can be used in combination with the substrate sheet to attain good handling properties of the colored nonwoven fabric when attached to the skin.

The substrate sheet is preferably used in the form of a mesh sheet.

In the present invention, by using the mesh sheet as the substrate sheet, when depositing the nanofibers on the collector, the nanofibers can be allowed to reach the uneven-shaped surface of the collector through pores of the mesh sheet, so that it is possible to obtain the colored nonwoven fabric that is provided with the mesh sheet as a core material while maintaining an uneven shape thereof. In this case, the mesh opening of the mesh sheet is preferably controlled to 20 to 200 meshes/inch, especially preferably 50 to 150 meshes/inch. In addition, the wire diameter of meshes of the mesh sheet is preferably 10 to 200 μm, especially preferably 30 to 150 μm. The material of the mesh sheet is preferably the same material as that of the nanofibers, though it is not particularly limited thereto.

[Release Sheet]

The colored nonwoven fabric according to the present invention may also be provided with a release sheet. In this case, it is preferred that the release sheet is releasably laminated on the colored nonwoven fabric. With such a construction, after adhering the side of the colored nonwoven fabric, for example, to the skin, the release sheet may be peeled off and removed from the colored nonwoven fabric, whereby it is possible to transfer the colored nonwoven fabric to the skin. From this viewpoint, it is preferred that the release sheet is directly laminated on the surface of the colored nonwoven fabric.

The Taber stiffness of the release sheet is preferably 0.01 to 0.4 mN·m and more preferably 0.01 to 0.2 mN m from the viewpoint of improving handling properties of the colored nonwoven fabric. The Taber stiffness may be measured by "Stiffness Testing Method" prescribed in JIS P8125: 2000.

The thickness of the release sheet may vary depending upon a material of the release sheet, and is preferably 5 to 500 μm and more preferably 10 to 300 μm from the viewpoint of improving handling properties of the colored nonwoven fabric. The thickness of the release sheet may be measured by the same method as used for measuring the thickness of the colored nonwoven fabric.

In the present invention, when using a grain-like artificial leather as the collector, the grain-like artificial leather may also be used as the release sheet for the colored nonwoven fabric. More specifically, in the configuration of laminating the colored nonwoven fabric on the grain-like artificial leather, after opposing the side of the colored nonwoven fabric to the skin, the surface of the colored nonwoven fabric is attached onto the skin. Then, the grain-like artificial leather is peeled off and removed from the colored nonwoven fabric, whereby only the colored nonwoven fabric remains attached to the skin. According to this method, it is possible to easily attach the colored nonwoven fabric to the skin even though the colored nonwoven fabric has a small thickness and therefore a low stiffness.

The release sheet preferably has slight heat shrinkability from the viewpoint of improving transfer properties of the colored nonwoven fabric to the skin. With the heat shrinkability of the release sheet, by heating the side of the release sheet after attaching the colored nonwoven fabric to the skin, the colored nonwoven fabric can be readily peeled and separated from the release sheet, so that it is possible to attain a good releasing state of the colored nonwoven fabric while reducing a physical force applied to the colored nonwoven fabric to a minimum level.

The release sheet is preferably so designed as to be releasable dividedly in parts from the colored nonwoven fabric. The release sheet having a small area can be released only by applying a weak force thereto. However, if it is intended to release the release sheet having a large area at the same time, it will be necessary to apply a large force thereto, which might result in deteriorated releasability thereof in some cases. In consequence, the release sheet is divided into parts to reduce a maximum value of an area of the sheet released to which a release force is applied simultaneously upon the releasing, so that it is possible to prevent a tension force exceeding durability of the colored nonwoven fabric from being applied thereto.

The release sheet also preferably has air permeability. When suitably selecting a material through which fibers or liquids are impermeable, but water vapor or air is permeable, as the material of the release sheet, it is possible to release the release sheet from the colored nonwoven fabric even though the surface of the colored nonwoven fabric has a fine uneven shape. More specifically, the Gurley air permeability of the release sheet is preferably not more than 30 seconds/100 mL and more preferably not more than 20 seconds/100 mL. The Gurley air permeability of the release sheet may be measured by the method prescribed in JIS P8117: 2009. The lower limit of the Gurley air permeability of the release sheet may be determined in consideration of the aforementioned Taber stiffness of the release sheet, and the like.

(Method of Using Colored Nonwoven Fabric)

The colored nonwoven fabric according to the present invention is preferably used by attaching the colored nonwoven fabric to the skin of the user. The colored nonwoven fabric according to the present invention is more preferably used, for example, as a skin patch sheet. Examples of the more concrete applications of the colored nonwoven fabric according to the present invention include cosmetic seals, skin-protective sheets, UV-protective sheets, and the like.

When attaching the colored nonwoven fabric according to the present invention to the skin of the user, an attachment assistant agent may be applied to the skin, and then the colored nonwoven fabric may be attached to the portion of the skin to which the attachment assistant agent is applied. More specifically, it is preferred that for example, after wetting the skin of the user with a liquid material or wetting the surface of the colored nonwoven fabric with the liquid material as the attachment assistant agent, the surface of the colored nonwoven fabric is brought into contact with the skin. With this procedure, it is possible to suitably adhere the colored nonwoven fabric to the skin by the action of surface tension.

As the method of keeping the surface of the skin or the colored nonwoven fabric in a wet state, there may be mentioned, for example, a method of spreading or spraying the liquid material thereonto. As the liquid material to be spread or sprayed, there may be used an aqueous liquid or an oily liquid. The aforementioned liquid material preferably has a higher surface tension no matter whether any of an aqueous liquid and an oily liquid is used as the liquid material.

In the present invention, in the case where the nanofibers contain a water-soluble polymer compound, an oily liquid may be used as the liquid material. However, it is more preferable to use an aqueous liquid as the liquid material. As the aqueous liquid, there may be used a substance containing water and having a viscosity of about 5,000 mPa·s or less as measured at 25° C. Examples of such a liquid material include water, an aqueous solution, a water dispersion, etc., as well as cosmetic emulsions for makeup, such as O/W emulsions or W/O emulsions, liquids thickened with a thickener, and the like. More specifically, as the liquid material, there may be used commercially available products, such as a skin lotion or a cosmetic cream.

As to the degree of wetting the surface of the skin or the surface of the colored nonwoven fabric by spreading or spraying the liquid material, if an aqueous liquid is used as the liquid material, it suffices that the aqueous liquid be applied in such a minimum amount as required for the aqueous liquid to sufficiently exhibit its surface tension and to dissolve the water-soluble polymer compound therein. More specifically, the amount of the liquid material to be applied may vary depending upon the size of the colored nonwoven fabric. However, in the case where the colored nonwoven fabric has a square shape of 3 cm×3 cm, the application of about 0.01 ml of the liquid material to the surface of the skin will be enough to attach the colored nonwoven fabric to the skin easily. When using the aqueous liquid as the liquid material and further using the water-soluble polymer compound, it is possible to exhibit a binder effect by dissolving the water-soluble polymer compound contained in the nanofibers in the aqueous liquid.

In addition, a solid or semisolid pre-makeup primer may be used as the attachment assistant agent in place of, or in addition to, a skin lotion or a cosmetic cream. The pre-makeup primer may be applied to the skin portion before the colored nonwoven fabric is attached thereto. Since the pre-makeup primer has the effect of smoothening the surface of the skin, the application of the colored nonwoven fabric to the skin under such a skin condition further improves adhesion of the colored nonwoven fabric to the skin, and further enhances the sense of unity of the colored nonwoven fabric with the skin in appearance.

Under such a condition that the liquid material is present between the colored nonwoven fabric and the skin, the bonding between the nanofibers is weakened due to the presence of the liquid material. In particular, in the case where the water-soluble polymer compound is contained in the nanofibers, the water-soluble polymer compound in the nanofibers is dissolved in the liquid material after attaching the colored nonwoven fabric to the skin, so that the bonding between the nanofibers is furthermore weakened. In this state, the fiber bonds at the periphery of the colored nonwoven fabric may be sheared to thereby smoothen the difference in level between the colored nonwoven fabric and the skin. As a result, the boundary between the colored nonwoven fabric and the skin is made less discernible to further enhance a sense of unity of the colored nonwoven fabric with the skin in appearance. Shearing the fiber bonds at the periphery of the colored nonwoven fabric can be achieved, for example, by applying a shear force to the peripheral portion of the colored nonwoven fabric which is kept in such a state as wetted by the liquid material after being attached to the skin. The shear force can be applied, for example, by lightly rubbing or stroking the peripheral portion of the colored nonwoven fabric with a finger, a nail, or a makeup tool, such as sponge, a cosmetic spatula, etc.

By transferring and attaching the colored nonwoven fabric having the uneven surface shape to the skin by the aforementioned method, it is possible to cover fine skin surface unevenness, such as fine wrinkles and pores, with the transferred colored nonwoven fabric to diminish the skin surface unevenness, and further an impression of a neat texture of the skin can be given to another person by the uneven shape of the surface of the colored nonwoven fabric which has been preliminarily designed thereon.

Moreover, when using a collector having a textured surface shape that reproduces the aforementioned texture of the skin as the uneven shape, the uneven shape of the colored nonwoven fabric attached to the skin reflects the unevenness of a facial contour of the user before attaching the colored nonwoven fabric thereto while reproducing the texture structure of the skin, so that it takes on an extremely natural surface profile and gloss. Therefore, such unnaturalness as observed when a thick film, for example, such as a silicone sheet, etc., is attached to the skin will hardly be perceived.

In addition, the colored nonwoven fabric attached to the skin serves for hiding or reducing skin color unevenness due to spots, freckles, bags under eyes, etc., and can exert good concealing effect thereon.

Also, the colored nonwoven fabric attached to the skin has high adhesion to the skin, and is therefore less likely to lose a sense of unity with the skin in appearance even though it is attached, for example, all day long. The colored nonwoven fabric having air permeability is less likely to impede the regulatory mechanism essentially possessed by the skin even when attached to the skin for a long period of time. Besides, even after the colored nonwoven fabric is continuously attached to the skin for a long period of time, the colored nonwoven fabric is easily removed from the skin simply by picking up between fingers.

After the colored nonwoven fabric according to the present invention is attached to the skin, makeup cosmetics may be put on the colored nonwoven fabric to thereby further enhance a sense of unity of the colored nonwoven fabric with the skin in appearance. Examples of the makeup cosmetics that may be put on the colored nonwoven fabric in such a case include an oil and a milky lotion containing the oil. The oil or the milky lotion applied to the colored nonwoven fabric is retained between the nanofibers constituting the colored nonwoven fabric, which can further enhance a sense of unity of the colored nonwoven fabric with the skin in appearance. The oil to be used preferably has a viscosity of 5.5 to 100 mPa·s as measured at room temperature (25° C.). Examples of the oil include hydrocarbon oils, polydimethylsiloxane (silicone oil), and the like. Of these oils, from the viewpoint of improving makeup longevity, preferred is polydimethylsiloxane (silicone oil).

After the colored nonwoven fabric according to the present invention is attached to the skin, various powdery makeup cosmetics, such as powder foundation, may be further put on the colored nonwoven fabric attached to the skin. By virtue of the thickness of the nanofibers or the distance between the nanofibers in the colored nonwoven fabric, the powdery makeup cosmetics can be well spread on the colored nonwoven fabric, so that a sense of unity of a portion of the skin where the powdery makeup cosmetics are directly applied, with the colored nonwoven fabric on which the powdery makeup cosmetics are put can be enhanced in appearance.

EXAMPLES

In the following descriptions, "%" indicate "% by mass," unless otherwise specified. Meanwhile, properties of polymers, etc., were measured by the following methods.

(1) Measurement of Number-Average Molecular Weight of Poly(N-Propionyl Ethyleneimine)

The number-average molecular weight of poly(N-propionyl ethyleneimine) was measured by gel permeation chromatography [measuring columns: two columns "K-804L" available from SHOWA DENKO K.K., connected in series to each other; flow rate: 1 mL/min; column temperature: 40° C.; detector: differential refractometer] using a 1 mmol/L solution of "FARMIN DM20" (tradename) available from Kao Corporation in chloroform as an eluent, and using polystyrenes having previously known molecular weights as a reference standard substance. The sample to be measured was used in an amount of 100 μL at a concentration of 5 mg/mL.

(2) Measurement of Volume-Average Particle Size of Non-White Colorant Particles

Using the following measuring apparatus, the volume-average particle size of the non-white colorant particles was measured under the following conditions.

Measuring Apparatus: Zeta potential/particle size measuring system "ELS-8000" commercially available from Otsuka Electrics Co., Ltd.

Measuring Conditions: Cumulant Analysis

The dispersion containing the particles to be measured was diluted with water so as to adjust a concentration of the particles therein to about $5\times10^{-3}$%, and the resulting dilute dispersion was filled in a cell for measurement. The measurement was conducted at a temperature of 25° C. and a cumulative number of 100 times, and a refractive index of water (1.333) was input to the measuring system as a refractive index of the dispersive solvent.

(3) Measurement of Volume-Average Particle Size of White Colorant Particles (Titanium Oxide Pigment Particles)

Using a laser diffraction/scattering particle size distribution measuring apparatus "LA950" available from HORIBA Ltd., under the condition that a refractive index of the titanium oxide and a refractive index of water were regarded as being 2.75 and 1.333, respectively, and further scales of a circulating rate and an ultrasonic wave of the apparatus were set at "5" and "3", respectively, a dispersion of the titanium oxide pigment particles was irradiated with an ultrasonic wave for 1 minute, followed by measuring particle sizes of the titanium oxide pigment particles in the dispersion. At this time, the value of the volume median particle size ($D_{50}$) thus measured was determined as a volume-average particle size of the titanium oxide pigment particles.

(4) Measurement of Solid Content

Using an infrared moisture meter "FD-230" available from Kett Electric Laboratory, 5 g of a sample to be measured was dried at a drying temperature of 150° C. under a measuring mode 96 (monitoring time: 2.5 minutes/variation range: 0.05%) to measure a water content (%) of the sample to be measured. The solid content of the sample was calculated according to the following formula.

Solid Content (%)=100−Water Content (%) of Sample to be Measured (5) Measurement of Solubility of Cellulose Using a Coulter counter "ZM80" available from Coulter Electronics, Inc., U.S.A., a mass of insoluble materials in a sample that was diluted 80 times with −5° C. ion-exchanged water was measured to determine a solubility of the sample.

(6) Measurement of Static Surface Tension of Water-Based Ink

A platinum plate was dipped in 5 g of a sample adjusted to 20° C. which was filled in a cylindrical polyethylene container (3.6 cm in diameter×1.2 cm in depth), and the static surface tension of the sample was measured at 20° C. using a surface tension meter "CBVP-Z" available from Kyowa Interface Science Co., Ltd., by a Wilhelmy method.

(7) Measurement of Viscosity of Water-Based Ink

The viscosity of the water-based ink was measured at 35° C. using an E-type viscometer "TV-25" (equipped with a standard cone rotor (1° 34'×R24); rotating speed: 50 rpm) available from Toki Sangyo Co., Ltd.

(8) Ascertainment of Uneven Shape of Collector and Measurement of Texture Depth

The ascertainment and measurement of the uneven shape on the surface of the collector were implemented by 3D measurement based on sectional profile using an industrial microscope "LEXT-OLS5000-SAT" available from Olympus Corporation. While appropriately changing a magnification of an objective lens of the microscope, depths of the uneven shape on the surface of a sample to measured were measured at 20 points selected as measuring objects per one sample, and an average value of the thus measured depths was calculated as a measurement value of a texture depth of the sample.

(9) Measurement of Thickness of Colored Nonwoven Fabric

The thickness of the colored nonwoven fabric was measured using a contact thickness gauge "LITEMATIC VL-50A" available from Mitutoyo Corporation. Incidentally, the measurement was conducted by using an R 5 mm cemented carbide spherical probe and applying a load of 0.01 Pa to the colored nonwoven fabric.

Synthesis Example 1 (Synthesis of Cationic Silicone Polymer 1)

A mixed solution prepared by mixing 73.7 g (0.74 mol) of 2-ethyl-2-oxazoline and 156.0 g of ethyl acetate was dehydrated with 12.0 g of a molecular sieve "ZEOLUM A-4" available from Tosoh Corporation at 28° C. for 15 hours. The resulting dehydrated ethyl acetate solution of 2-ethyl-2-oxazoline was mixed with 2.16 g (0.014 mol) of diethyl sulfate, and the obtained mixture was refluxed under heating at 80° C. in a nitrogen atmosphere for 8 hours, thereby obtaining the solution of terminal-reactive poly(N-propionyl ethyleneimine) (number-average molecular weight: 6,000).

Separately, a mixed solution prepared by mixing 70.0 g of a side-chain primary aminopropyl-modified poly(dimethyl siloxane) "KF-864" (weight-average molecular weight: 50,000 (catalogue value); amine equivalent: 3,800) available from Shin-Etsu Chemical Co., Ltd., and 140.0 g of ethyl acetate with each other was dehydrated with 15.0 g of the molecular sieve at 28° C. for 15 hours.

Next, the terminal-reactive poly(N-propionyl ethyleneimine) solution obtained above was added to the aforementioned dehydrated side-chain primary aminopropyl-modified poly(dimethyl siloxane) solution at one time, followed by refluxing the obtained mixed solution under heating at 80° C. for 10 hours. The resulting reaction mixture was concentrated under reduced pressure to obtain a poly(N-propionyl ethyleneimine)/dimethyl polysiloxane copolymer (hereinafter also referred to as a "cationic silicone polymer 1") in the form of a white rubber-like solid (135 g). The mass ratio of a content of an organopolysiloxane segment (x) to a total content of the organopolysiloxane segment (x) and a poly(N-acyl alkylene imine) segment (y) [content of organopolysiloxane segment (x)/total content of organopolysiloxane segment (x) and poly(N-acyl alkylene imine) segment (y)] in the polymer was 0.50, and the weight-average molecular weight of the cationic silicone polymer 1 was 100,000 (calculated value). The resulting cationic silicone polymer 1 was mixed with first-grade ethanol, thereby obtaining a solution of the cationic silicone polymer 1 (solid content: 30%).

Production Examples 1-1 to 1-5 (Production of Non-White Pigment Water Dispersion)

(Step I: Production of Colorant Dispersion Liquid)

A sealable and temperature-controllable glass jacket was charged with 200 g of a solution of an anionic acrylic polymer "Plascize L-9909B" (acid value: 50 mgKOH/g; unneutralized product; an ethanol solution having a solid content of 40%) as a water-dispersive polymer available from GOO Chemical Co., Ltd. While stirring the solution under the conditions including a jacket temperature of 15° C. and a rotating speed of 1,400 rpm using a high-speed disperser "T.K. ROBOMIX" (equipped with "HOMODISPER 2.5 Model" as a stirring device (blade diameter: 40 mm)) available from Primix Corporation, 200 g of the colorant shown in Table 1 was added thereto, and the resulting mixture was further stirred under the conditions including a jacket temperature of 15° C. and a rotating speed of 2,000 rpm for 1 hour to render the colorant compatible with the anionic acrylic polymer solution.

Next, while maintaining the jacket temperature of 15° C., the rotating speed of the disperser was changed to 8,000 rpm at which 170 g of the first grade ethanol, 17.1 g of a 5N NaOH aqueous solution and 412.9 g of ion-exchanged water were charged into the jacket, and the contents of the jacket were stirred for 3 hours, thereby obtaining a colorant mixture (concentration of ethanol in medium: 40.4%; solid content: 28%).

The thus obtained colorant mixture was subjected to dispersion treatment by passing the mixture through a Microfluidizer "Model: M-140K" available from Microfluidics Corporation under a pressure of 180 MPa 20 times (number of passes), followed by adding 900 g of ion-exchanged water thereto, thereby obtaining respective colorant dispersion liquids each having a solid content of 14.7%.

The thus obtained colorant dispersion liquids were respectively subjected to measurement for a volume-average particle size of colorant particles contained therein. The volume-average particle sizes of the colorant particles in the respective colorant dispersion liquids are shown in Table 1.

(Step II: Removal of Organic Solvent)

Using a reduced-pressure distillation apparatus (rotary evaporator) "N-1000S Model" available from Tokyo Rikakikai Co., Ltd., the resulting colorant dispersion liquids were respectively maintained in a warm bath adjusted to 40° C. under a pressure of 10 kPa for 2 hours to remove the organic solvent therefrom. The resulting dispersion was further maintained in the warm bath adjusted to 62° C. under the pressure reduced to 7 kPa for 4 hours to remove the organic solvent and a part of water therefrom such that a total concentration of the colorant and the water-dispersive polymer in the dispersion (solid content) was controlled to the range of 23 to 25%. Then, while measuring the total concentration of the colorant and the water-dispersive polymer (solid content), ion-exchanged water was added to the dispersion so as to control the total concentration of the colorant and the water-dispersive polymer therein to 20.0%.

Next, the thus obtained respective dispersions were subjected to filtration treatment by passing through 5 μm-mesh and 1.2 μm-mesh membrane filters "Minisart" available from Sartorius Inc., in sequential order, thereby obtaining respective colorant water dispersions.

The volume-average particle sizes of the colorant particles in the resulting respective colorant water dispersions are shown in Table 1.

The details of the colorants shown in Table 1 are as follows.

Yellow No. 5: Yellow pigment "Sun CROMA FD & C Yellow 6 Al Lake" (C.I. Pigment Yellow 104) available from Sun Chemical Corporation.

Yellow No. 4: Yellow pigment "BC Yellow No. 4 AL" (C.I. Pigment Yellow 100) available from Kishi Kasei Co., Ltd.

Blue No. 1: Blue pigment "Sun CROMA FD & C Blue 1 Al Lake" (C.I. Food Blue 2 Aluminum Lake) available from Sun Chemical Corporation.

Red No. 10441): Red pigment "Sun CROMA D & C Red 28 Al Lake" (C.I. Acid Red 92) available from Sun Chemical Corporation.

Red No. 226: Red dye; "Red No. 226 K" (C.I. Vat Red 1) available from Kishi Kasei Co., Ltd.

TABLE 1

| | | | Production Examples | | | | |
|---|---|---|---|---|---|---|---|
| | | | 1-1 | 1-2 | 1-3 | 1-4 | 1-5 |
| No. of colorant water dispersion | | | 1 | 2 | 3 | 4 | 5 |
| Step I | Kind of colorant | | Yellow No. 5 | Yellow No. 4 | Blue No. 1 | Red No. 104-(1) | Red No. 226 |
| | Formulation of colorant mixture (g) | Colorant | 200 | 200 | 200 | 200 | 200 |
| | | Solution of anionic acrylic polymer (solid content: 40%) | 200 | 200 | 200 | 200 | 200 |
| | | Ethanol | 170 | 170 | 170 | 170 | 170 |
| | | Ion-exchanged water | 412.9 | 412.9 | 412.9 | 412.9 | 412.9 |
| | | 5N NaOH aqueous solution | 17.1 | 17.1 | 17.1 | 17.1 | 17.1 |
| | Mass ratio [colorant/water-dispersive polymer] in colorant mixture | | 2.5 | 2.5 | 2.5 | 2.5 | 2.5 |
| | Mass ratio [organic solvent/water] in colorant mixture | | 0.68 | 0.68 | 0.68 | 0.68 | 0.68 |
| | Conditions of dispersion treatment of colorant mixture | | 180 MPa; 20 passes | | | | |
| | Amount (g) of ion-exchanged water added after dispersion treatment | | 900 | 900 | 900 | 900 | 900 |
| | Solid content (%) of colorant dispersion liquid | | 14.7 | 14.7 | 14.7 | 14.7 | 14.7 |
| | Volume-average particle size (nm) of colorant particles in colorant dispersion liquid | | 160 | 173 | 129 | 112 | 156 |

TABLE 1-continued

| | | Production Examples | | | | |
|---|---|---|---|---|---|---|
| | | 1-1 | 1-2 | 1-3 | 1-4 | 1-5 |
| Step II | Mass ratio [organic solvent/water] in colorant dispersion liquid | 0.22 | 0.22 | 0.22 | 0.22 | 0.22 |
| | Conditions for removal of organic solvent | 40° C.; 10 kPa; 2 hr + 62° C.; 7 kPa; 4 hr | | | | |
| | Solid content (%) of colorant water dispersion | 20.0 | 20.0 | 20.0 | 20.0 | 20.0 |
| | Volume-average particle size (nm) of colorant particles in colorant water dispersion | 157 | 169 | 125 | 109 | 152 |

Production Example 1-6 (Production of White Pigment Water Dispersion)

(Step I: Colorant Dispersing Step)

A 1,000 mL-capacity polypropylene bottle available from SANPLATEC Corporation was charged with 33.4 g of the solution of the cationic silicone polymer 1 obtained as the water-dispersive polymer in Synthesis Example 1 (solid content: 30%), 200 g of a titanium oxide pigment "SI-Titan CR-50LHC" (surface-treated titanium oxide: treated with aluminum hydroxide and hydrogen dimethicone) as a white pigment available from Miyoshi Kasei Inc., 170 g of first-grade ethanol, and 1.6 g of citric acid. The contents of the bottle were shaken by hand to fully suspend the titanium oxide pigment in the solution of the cationic silicone polymer 1.

Then, 2,000 g of 1.2 mmϕ zirconia beads were added to the resulting suspension, and the obtained mixture was subjected to dispersion treatment using a bench top-type pot mill pedestal available from AS ONE Corporation at 250 rpm for 8 hours, followed by subjecting the resulting dispersion to filtration treatment through a metal mesh filter to remove the zirconia beads from the dispersion.

Next, while stirring the obtained dispersion at a rotating speed of 1,400 rpm using a high-speed disperser "T.K. ROBOMIX" (equipped with "HOMODISPER 2.5 Model" (blade diameter: 40 mm) as a stirring device) available from Primix Corporation, 200 g of a solution of an anionic acrylic polymer "Plascize L-9909B" (acid value: 50 mgKOH/g; unneutralized product; an ethanol solution having a solid content of 40%) as a water-dispersive polymer available from GOO Chemical Co., Ltd., was added to the dispersion, followed by increasing the rotating speed up to 2,000 rpm at which the dispersion was stirred for 1 hour. Then, after the rotating speed was changed to 8,000 rpm at a jacket temperature of 15° C., 17.1 g of a 5N NaOH aqueous solution and 412.9 g of ion-exchanged water were added to the dispersion, and the resulting mixture was stirred for 3 hours, thereby obtaining a colorant mixture (concentration of ethanol in medium: 42.3%; solid content: 28%).

The thus obtained colorant mixture was subjected to dispersion treatment by passing the mixture through a Microfluidizer "Model: M-140K" available from Microfluidics Corporation under a pressure of 180 MPa 20 times (number of passes), followed by adding 900 g of ion-exchanged water thereto, thereby obtaining a colorant dispersion liquid having a solid content of 14.7%. The thus obtained colorant dispersion liquid was subjected to measurement for a volume-average particle size of colorant particles contained therein. The volume-average particle sizes of the colorant particles in the colorant dispersion liquid is shown in Table 2.

(Step II: Step of Removing Organic Solvent)

The same method for conducting the step II as described in Production Examples 1-1 to 1-5 was repeated to obtain a colorant water dispersion 6. The thus obtained colorant water dispersion 6 was subjected to measurement for a volume-average particle size of colorant particles contained therein. The volume-average particle size of the colorant particles in the colorant water dispersion 6 is shown in Table 2.

TABLE 2

| | | | Production Example 1-6 |
|---|---|---|---|
| No. of colorant water dispersion | | | 6 |
| Step I | Kind of colorant | | SI-Titan CR-50LHC |
| | Formulation of colorant mixture (g) | Colorant | 200 |
| | | Solution of cationic silicone polymer 1 (solid content: 30%) | 33.4 |
| | | Ethanol | 170 |
| | | Citric acid | 1.6 |
| | | Solution of anionic acrylic polymer (solid content: 40%) | 200 |
| | | Ion-exchanged water | 412.9 |
| | | 5N NaOH aqueous solution | 17.1 |
| | Mass ratio [colorant/water-dispersive polymer] in colorant mixture | | 2.2 |
| | Mass ratio [organic solvent/water] in colorant mixture | | 0.73 |
| | Conditions of dispersion treatment of colorant mixture | | 180 MPa; 20 passes |
| | Amount (g) of ion-exchanged water added after dispersion treatment | | 900 |
| | Solid content (%) of colorant dispersion liquid | | 14.7 |
| | Volume-average particle size (nm) of colorant particles in colorant dispersion liquid | | 325 |

TABLE 2-continued

| | | Production Example 1-6 |
|---|---|---|
| Step II | Mass ratio [organic solvent/water] in colorant dispersion liquid | 0.22 |
| | Conditions for removal of organic solvent | 40° C.; 10 kPa; 2 hr + 62° C.; 7 kPa; 4 hr |
| | Solid content (%) of colorant water dispersion | 20.0 |
| | Volume-average particle size (nm) of colorant particles in colorant water dispersion | 319 |

(Preparation of Resin Solution Containing Polymer Compound A)

Preparation Example 1-1

A completely saponified polyvinyl alcohol "KURARAY POVAL" (product number: 29-99; saponification degree: not less than 99.3 mol %) as the polymer compound A available from Kuraray Co., Ltd., was dissolved in water to prepare a 15% aqueous solution thereof, thereby obtaining a resin solution 1.

Preparation Example 1-2 (Preparation of Resin Solution 2)

A coniferous dissolving pulp produced by a sulfite method "ALAPUL-T" (tree species: spruce; α-cellulose: 90.1%; relative viscosity: 4.64) available from Alaska Pulp Corporation was subjected to blasting treatment using a 30 L automatic blasting apparatus available from Tukishima Kikai Co., Ltd., thereby obtaining a blast cellulose having a viscosity-average degree of polymerization (DPv) of 320. The saturation water vapor pressure upon blasting was 15 $kg/cm^2G$.

The resulting blast cellulose was cooled to 4° C., and 12.5 g of the blast cellulose as a dry mass thereof was charged into a 500 L metal beaker to which 187.5 g of a NaOH aqueous solution preliminarily cooled to 4° C. was further added, thereby obtaining 200 g in total of a cellulose alkali slurry having a NaOH concentration of 5%.

The resulting slurry was cooled to −5° C. and then subjected wet pulverization while maintaining a temperature of −2° C. to −5° C. using a media-type wet pulverizer "Pearl Mill PM5-VS" available from ASHIZAWA FINETECH Ltd., so as to control an average particle size of particles in the slurry to 12 μm. The viscosity-average degree of polymerization (DPv) of the cellulose after subjecting the slurry to the wet pulverization was 304.

Next, 50 g of a NaOH aqueous solution having a concentration of 18% which has been preliminarily cooled to −10° C. was added to the slurry subjected to the wet pulverization treatment to control concentrations of the cellulose and NaOH in the slurry to 5% and 7.6%, respectively, and then deaggregated using a high-speed disperser "T.K. ROBOMIX" available from Primix Corporation at a rotating speed of 12,000 rpm for 10 minutes while maintaining a temperature of −2° C. to −5° C., thereby obtaining a cellulose solution. The cellulose obtained after the deaggregation had a solubility of not less than 99.9% and a viscosity of 1 Pa s.

The resulting cellulose solution was subjected to pressure filtration through a 400-mesh metal filter while maintaining the solution in the temperature range of −2° C. to −5° C., thereby obtaining a resin solution 2 having a cellulose concentration of 5%.

The resulting resin solution 2 was clear in the solution temperature range of −2° C. to −5° C. The resin solution was temperature-controlled and stored in the solution temperature range of −2° C. to −5° C. until subjecting the solution to electrospinning irrespective of whether or not it was mixed with the colorant water dispersion.

Preparation Examples 2-1 to 2-3 (Preparation of Colorant-Containing Injection Liquids 1 to 3)

The resin solution 1 obtained Preparation Example 1-1 was mixed with the colorant water dispersion(s) at the compounding ratio shown in Table 4, and the resulting mixture was stirred, thereby preparing respective colorant-containing injection liquids.

Preparation Examples 2-4 to 2-6 (Preparation of Colorant-Containing Injection Liquids 4 to 6)

The resin solution 2 obtained Preparation Example 1-2 was mixed with the colorant water dispersion(s) cooled to −2° C. at the compounding ratio shown in Table 5, and the resulting mixture was stirred in the temperature range of −2° C. to −5° C., thereby preparing respective colorant-containing injection liquids.

(Production of Colorant Nonwoven Fabric)

Examples 1-1 and 1-4

[Step 1-1]

The collector having a skin texture-reproduced surface as shown in Table 4 was used as a collector having an uneven shape on a surface thereof. The respective injection liquids shown in Table 4 were filled in a syringe of a resin solution-type electrospinning apparatus "Nanofiber Electrospinning Unit" available from Kato Tech Co., Ltd., and injected onto the skin texture-reproduced surface of the collector under the injection conditions shown in Table 4 to deposit nanofibers on a region of 3 cm in width and 5 cm in length on the skin texture-reproduced surface.

Next, the nanofibers deposited were subjected to heat treatment at 180° C. for 20 minutes, so that the completely saponified polyvinyl alcohol in the nanofibers was crystallized and subjected to water-insolubilizing treatment, thereby obtaining a colored nonwoven fabric laminated on the surface of the collector. The thickness of the resulting colored nonwoven fabric was 20 μm, the thickness of the respective nanofibers therein was 100 to 500 nm, the total content of the colorant in the colored nonwoven fabric was 46%, and the content of the colorant on the basis of the nanofibers in the colored nonwoven fabric was 85%.

Incidentally, the collectors used in Examples 1-1 and 1-4 as shown in Table 4 are as follows.

Texture 1: Texture sample 1 formed of nylon 66 on which a skin texture-reproduced surface was formed by acquiring information on a skin texture of the back of the hand to be treated ("MTJ-402"; kind: composite leather; texture depth: 120 μm; draft angle: 12°) available from Mold-Tech Japan Co., Ltd.

SUPULARE: Artificial leather "SUPULARE PBZ13001" on which a skin texture-reproduced surface was formed, available from IDEATEX Japan Co., Ltd.

Examples 1-2 and 1-5

[Step 1-1] The same procedure as used above in each of Examples 1-1 and 1-4 was repeated except that the injection liquid 1 was replaced with the injection liquid 2 shown in Table 4, thereby obtaining a colored nonwoven fabric laminated on the surface of the collector.

[Step 3]

Ink-jet printing was conducted on the uneven-shaped surface of the colored nonwoven fabric obtained in the step 1-1 using a water-based ink 1 for ink-jet printing shown in Table 4.

The water-based ink 1 for ink-jet printing shown in Table 4 which was prepared by the following method was filled into a handy printer cartridge "HC-01K" available from Ricoh Company, Ltd., whose interior was previously fully rinsed with ion-exchanged water and dried, and then using the "Ricoh Handy Printer" (tradename) available from Ricoh Company, Ltd., ink-jet printing (resolution: 600 dpi× 600 dpi; amount of ink droplets ejected: 10 pL) was conducted on the colored nonwoven fabric obtained in the step 1-1 to form a solid image as a printed image to be used herein.

Immediately after the printing, while measuring the temperature of the printed surface using a radiation thermometer "IT-540S" available from HORIBA Ltd., so as not to raise the temperature of the printed surface to 50° C. or higher, the resulting printed image was dried for 5 minutes by a hot air dryer while repeating On and OFF of blowing of hot air therefrom, thereby obtaining a colored nonwoven fabric laminated on the surface of the collector. The thickness of the resulting colored nonwoven fabric was 20 μm, the thickness of the respective nanofibers therein was 100 to 500 nm, the total content of the colorant in the colored nonwoven fabric was 46%, and the content of the colorant on the basis of the nanofibers in the colored nonwoven fabric was 85%.

Figure 4:
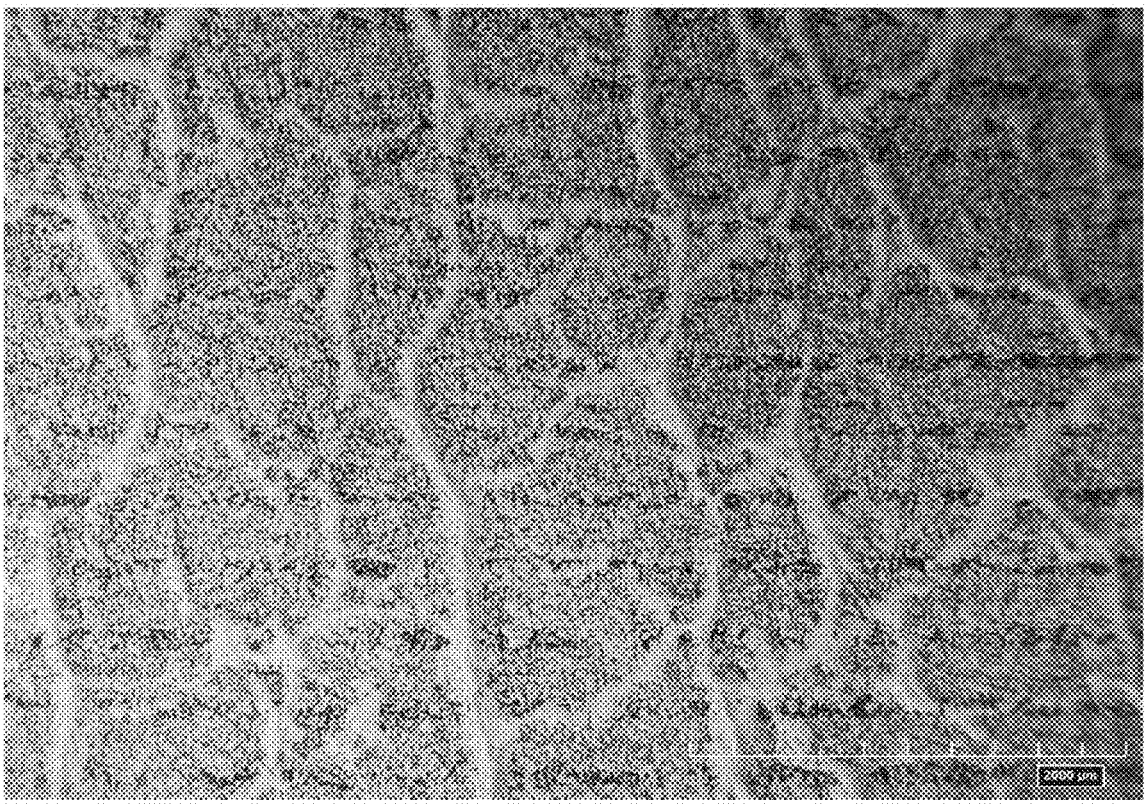
FIG. 4 is an enlarged photograph (magnification: ×50 times) of the colored nonwoven fabric obtained in Example 1-5.

The surface of the colored nonwoven fabric obtained in Example 1-5 which had been in contact with the collector was photographed. An enlarged photo of the surface of the colored nonwoven fabric is shown in FIG. 4. Incidentally, one division of a scale bar shown in a right lower portion of the enlarged photo of FIG. 4 indicates 200 μm.

(Preparation of Water-Based Ink 1 for Ink-Jet Printing)

According to the kinds and amounts shown in Table 4, the colorant water dispersion, polyethylene glycol 400 (hereinafter also referred to merely as "PEG400"), 1,2-hexanediol, 1,2-propanediol, a modified glycerin "Liponic EG-1" (ethyleneoxide 26 mol adduct of glycerin) available from Vantage Specialty Ingredients Inc., (hereinafter referred to merely as "Liponic EG-1") and ion-exchanged water were added and mixed with each other, and the resulting mixed solution was subjected to filtration treatment through a 0.45 μm-mesh membrane filter "Minisart" available from Sartorius Inc., thereby obtaining a water-based ink 1. The static surface tension of the thus obtained water-based ink 1 as measured at 20° C. was 36 mN/m.

Examples 1-3 and 1-6

[Step 2-1]

The collector having a skin texture-reproduced surface as shown in Table 4 was used as a collector having an uneven shape on a surface thereof. The respective injection liquids shown in Table 4 were filled in a syringe of a resin solution-type electrospinning apparatus "Nanofiber Electrospinning Unit", and injected onto the skin texture-reproduced surface of the collector under the injection conditions shown in Table 4 to deposit nanofibers on a region of 3 cm in width and 5 cm in length on the skin texture-reproduced surface.

Next, the nanofibers deposited on the surface of the collector were subjected to heat treatment at 180° C. for 20 minutes, so that the completely saponified polyvinyl alcohol in the nanofibers was crystallized and subjected to water-insolubilizing treatment, thereby obtaining an uncolored nonwoven fabric laminated on the surface of the collector.

[Step 2-2]

Ink-jet printing was conducted on the uneven-shaped surface of the respective uncolored nonwoven fabrics obtained in the step 2-1 using a water-based ink 2 for ink-jet printing shown in Table 4.

The water-based ink 2 for ink-jet printing shown in Table 4 which was prepared by the same method as used for producing the aforementioned water-based ink 1 for ink-jet printing was filled into a handy printer cartridge "HC-01K" available from Ricoh Company, Ltd., whose interior was previously fully rinsed with ion-exchanged water and dried, and then using the "Ricoh Handy Printer" (tradename) available from Ricoh Company, Ltd., ink-jet printing (resolution: 600 dpi×600 dpi; amount of ink droplets ejected: 10 pL) was conducted on the uncolored nonwoven fabric obtained in the step 2-2 to form a solid image as a printed image to be used herein.

Immediately after the printing, while measuring the temperature of the printed surface using a radiation thermometer "IT-540S" available from HORIBA Ltd., so as not to raise the temperature of the printed surface to 50° C. or higher, the resulting printed image was dried for 5 minutes by a hot air dryer while repeating On and OFF of blowing of hot air therefrom, thereby obtaining a colored nonwoven fabric laminated on the surface of the collector. The thickness of the resulting colored nonwoven fabric was 20 μm, the thickness of the respective nanofibers therein was 100 to 500 nm, the total content of the colorant in the colored nonwoven fabric was 46%, and the content of the colorant on the basis of the nanofibers in the colored nonwoven fabric was 85%.

Examples 1-7 and 1-10

[Step 1-1]

The collector having a skin texture-reproduced surface as shown in Table 5 was used as a collector having an uneven shape on a surface thereof. The respective injection liquids shown in Table 5 whose temperature was maintained at −5° C. were filled in a syringe of a resin solution-type electrospinning apparatus "Nanofiber Electrospinning Unit", and injected onto the skin texture-reproduced surface of the collector under the injection conditions shown in Table 5 to deposit nanofibers on a region of 3 cm in width and 5 cm in length on the skin texture-reproduced surface.

Next, the nanofibers deposited on the surface of the collector were subjected to neutralization washing treatment with 100 mL of a 1% citric acid aqueous solution, so that the alkali-soluble cellulose in the nanofibers was subjected to water-insolubilizing treatment, thereby obtaining a colored nonwoven fabric laminated on the surface of the collector. The thickness of the resulting colored nonwoven fabric was 25 μm, the thickness of the respective nanofibers was 100 to 500 nm, the total content of the colorant in the colored nonwoven fabric was 37%, and the content of the colorant on the basis of the nanofibers in the colorant was 60%.

Incidentally, the collectors shown in Table 5 are the same as those shown in Table 4.

Examples 1-8 and 1-11

[Step 1-1]

The same procedure as used above in each of Examples 1-7 and 1-10 was repeated except that the injection liquid 4 was replaced with the injection liquid 5 shown in Table 5, thereby obtaining a colored nonwoven fabric laminated on the surface of the collector.

[Step 3]

The same procedure for ink-jet printing as in Example 1-2 was conducted on the uneven-shaped surface of the colored nonwoven fabric obtained in the step 1-1 using a water-based ink 3 for ink-jet printing shown in Table 5 which was prepared by the same method as used for production of the aforementioned water-based ink 1 for ink-jet printing.

Immediately after the printing, while measuring the temperature of the printed surface using a radiation thermometer "IT-540S" available from HORIBA Ltd., so as not to raise the temperature of the printed surface to 50° C. or higher, the resulting printed image was dried for 5 minutes by a hot air dryer while repeating On and OFF of blowing of hot air therefrom, thereby obtaining a colored nonwoven fabric laminated on the surface of the collector. The thickness of the resulting colored nonwoven fabric was 25 μm, the thickness of the respective nanofibers therein was 100 to 500 nm, the total content of the colorant in the colored nonwoven fabric was 37%, and the content of the colorant on the basis of the nanofibers in the colored nonwoven fabric was 60%.

Examples 1-9 and 1-12

[Step 2-1]

Using the collector having a skin texture-reproduced surface as shown in Table 5, the injection liquid 6 shown in Table 5 whose temperature was maintained at −5° C. was filled in a syringe of a resin solution-type electrospinning apparatus "Nanofiber Electrospinning Unit", and injected onto the skin texture-reproduced surface of the collector under the injection conditions shown in Table 5 to deposit nanofibers on a region of 3 cm in width and 5 cm in length on the skin texture-reproduced surface.

Next, the nanofibers deposited on the surface of the collector were subjected to neutralization washing treatment with 100 mL of a 1%-conc. citric acid aqueous solution, so that the alkali-soluble cellulose in the nanofibers was subjected to water-insolubilizing treatment, thereby obtaining an uncolored nonwoven fabric laminated on the surface of the collector.

[Step 2-2]

The same procedure for ink-jet printing as in Example 1-3 was conducted on the uneven-shaped surface of the uncolored nonwoven fabric obtained in the step 2-1 except for using a water-based ink 4 for ink-jet printing shown in Table 5 which was prepared by the same method as used for production of the aforementioned water-based ink 1 for ink-jet printing.

Immediately after the printing, while measuring the temperature of the printed surface using a radiation thermometer "IT-540S" available from HORIBA Ltd., so as not to raise the temperature to 50° C. or higher, the resulting printed image was dried for 5 minutes by a hot air dryer while repeating On and OFF of blowing of hot air therefrom, thereby obtaining a colored nonwoven fabric laminated on the surface of the collector. The thickness of the resulting colored nonwoven fabric was 25 μm, the thickness of the respective nanofibers therein was 100 to 500 nm, the total content of the colorant in the colored nonwoven fabric was 37%, and the content of the colorant on the basis of the nanofibers in the colored nonwoven fabric was 60%.

Comparative Example 1-1

The same procedure as in Example 1-1 was repeated except for using a plain PET film "LUMIRROR" (product number: #50-S10) available from Toray Industries Inc., as a collector, thereby obtaining a colored nonwoven fabric. The thickness of the resulting colored nonwoven fabric was 20 μm, and the thickness of the respective nanofibers was 100 to 500 nm.

Comparative Example 1-2

A dry-type face mask "OHADAOMOI (skin-comfortable) Face Mask" available from TEIJIN FRONTIER Co., Ltd., (using super ultrafine nanofibers "NANOFRONT" available from TEIJIN FRONTIER Co., Ltd.) was pressed against the skin texture-reproduced surface of the texture sample 1 used in Example 1-1 under a pressure of 1 kg/cm$^2$ for 30 seconds to thereby subject the face mask to embossing treatment.

Next, the resulting embossed face mask was subjected to ink-jet printing by the same method as used in the step 2-2 of Example 1-3 using the aforementioned water-based ink 2 for ink-jet printing, thereby obtaining an embossed colored nonwoven fabric.

Comparative Example 1-3

The injection liquid 1 used in Example 1-1 was applied onto the skin texture-reproduced surface of the texture sample 1 used in Example 1-1 by a wire bar coater in such an amount that the thickness of the resulting coating film after being dried was 20 μm. The thus obtained colored coating film on the collector was subjected to heat treatment at 180° C. for 20 minutes, so that the completely saponified polyvinyl alcohol in the coating film was crystallized and subjected to water-insolubilizing treatment.

However, the coating film was penetrated into the uneven surface of the texture sample 1 used as the collector, so that it was difficult to peel off the coating film from the collector, and in particular, when peeling off the coating film, the end portion of the uneven texture pattern of the coating film was frequently likely to partially remain on the side of the texture sample. Upon evaluation for the following items, there was used only the portion of the colored coating film which could be recovered from the collector.

[Evaluation of Colored Nonwoven Fabric]

[Flexibility]

The back of a left hand of a 45 years old male (one person) as a subject was washed with a commercially available facial cleaner, and then the cleaner droplets remained attached thereonto were removed by wiping off them with a towel. Thereafter, the back of the left hand and its surrounding portions of the subject were wet with a milky lotion containing the following formulation components.

Next, the colored nonwoven fabric obtained in the aforementioned respective Examples and Comparative Examples in the state before being peeled off from the collector was attached onto the back of the left hand of the subject. Then, the collector was peeled off and removed from the colored nonwoven fabric, so that only the colored nonwoven fabric was allowed to remain attached onto the back of the left hand. However, the colored coating films obtained in Comparative Examples 1 to 3 were previously peeled off from the texture sample 1, and respectively attached onto the back of the left hand of the subject.

Then, the subject bent fingers of his left hand onto the back of which the colored nonwoven fabric or the colored coating film was attached so as to make a first and thereby stretch the skin on the back of the hand, and then opened the hand to the maximum so as to contract the skin on the back of the hand. This motion including stretching and contracting the skin on the back of the left hand of the subject was repeated 100 times respectively. Thereafter, the colored nonwoven fabric or the colored coating film on the back of the left hand of the subject was observed to ascertain whether or not any breakage or deformation occurred therein, as well as a gloss in appearance, thereby evaluating flexibility of the colored nonwoven fabric or the colored coating film. The results are shown in Tables 4 and 5. In the following evaluation ratings, when the rating is 3 or 2, the colored nonwoven fabric or the colored coating film exhibited good flexibility that makes it followable with facial expression or motion of a body, and therefore was practically usable.

(Evaluation Ratings)

3: Neither breakage nor deformation occurred, and no change in gloss in appearance was present.

2: Although none of breakage and deformation occurred, a change in gloss in appearance was present.

1: Breakage and deformation occurred.

| (Formulation Components (% by mass) of Milky Lotion) | |
|---|---|
| Oxyethylene/methyl polysiloxane copolymer*1 | 2.0 |
| Methyl polysiloxane 10CS*2 | 3.0 |
| Methyl polysiloxane 100CS*3 | 15.0 |
| Cetanol*4 | 1.5 |
| Squalane*5 | 5.0 |
| Dibutyl hydroxy toluene*6 | 0.02 |
| Propyl p-hydroxybenzoate*7 | 0.1 |
| Glycerin | 3.0 |
| 1,2-Propanediol | 3.0 |
| Ion-exchanged water | balance |
| Total | 100.0 |

Incidentally, the respective asterisked notations described above are as follows.

*1"KF6015" available from Shin-Etsu Chemical Co., Ltd.

*2"KF-96A-10CS" available from Shin-Etsu Chemical Co., Ltd.

*3"KF-96A-100CS" available from Shin-Etsu Chemical Co., Ltd.

*4, *5, *6 and *7Products available from FUJIFILM Wako Pure Chemical Corporation.

[Rub Fastness]

An artificial leather "SUPULARE PBZ13001" available from IDEATEX Japan Co., Ltd., was attached onto a bottom surface (1 inch×1 inch) of a 50 g weight through a double-sided adhesive tape.

The colored nonwoven fabric or the colored coating film obtained in the aforementioned respective Examples and Comparative Examples was peeled off from the collector, and the portion of the print pattern formed on the surface of the colored nonwoven fabric or the colored coating film which had been opposed to the collector was reciprocatively rubbed with the SUPULARE-attached surface of the weight 10 times. After the rubbing, the rubbed surface of the colored nonwoven fabric or the colored coating film was visually observed to ascertain whether or not any deformation, breakage or the like was present therein, as well as an appearance thereof, thereby evaluating rub fastness of the colored nonwoven fabric or the colored coating film. The results are shown in Tables 4 and 5. In the following evaluation ratings, when the rating is 3 or 2, the colored nonwoven fabric or the colored coating film was practically usable.

(Evaluation Ratings)

3: Neither breakage nor deformation occurred, and no change in gloss in appearance was present.

2: Although none of breakage and deformation occurred, a change in gloss in appearance was present.

1: Breakage and deformation occurred.

[Gloss Feel and Transparent Feel]

The colored nonwoven fabric or the colored coating film obtained in the aforementioned respective Examples and Comparative Examples was peeled off from the collector, and the portion of the print pattern formed on the surface of the colored nonwoven fabric or the colored coating film which had been opposed to the collector was measured for a glossiness thereof under a light-irradiation condition of 60° using a gloss meter "IG-330" available from HORIBA Ltd., to evaluate a gloss feel and a transparent feel of the colored nonwoven fabric or the colored coating film. The results are shown in Tables 4 and 5.

(Evaluation Ratings)

Glossiness of less than 20: Having a gloss feel and a transparent feel close to those of a human skin, and therefore looking natural even when attached to the skin.

Glossiness of not less than 20 and less than 40: Having a higher gloss feel than that of a human skin, and a low transparent feel, and seeming to generate facial shine owing to sebum, so that the attached portion on the skin was readily discernible.

Glossiness of not less than 40: Having a higher gloss feel than that of a human skin, and no transparent feel.

[Concealability (Against Spots on Face)]

A 45 years old male (one person) having big dark spots on his left cheek was selected as a subject. A whole part of the face of the subject was washed with a facial cleaner generally available on the market, and then the water droplets remained attached thereonto were removed by wiping off them with a towel. Thereafter, the facial skin spots and their surrounding portions of the subject were wet with the milky lotion used above for evaluating the flexibility. Next, the colored nonwoven fabric or the colored coating film obtained in the aforementioned respective Examples and Comparative Examples in the state before being peeled off from the collector was attached onto the facial skin spots of the subject. Then, the collector was peeled off and removed from the colored nonwoven fabric or the colored coating film, so that the colored nonwoven fabric or the colored coating film was attached and transferred to regions immediately above the facial skin spots and their surrounding portions.

Then, the left cheek of the subject onto which the colored nonwoven fabric or the colored coating film was attached was presented to 10 expert panelists for cosmetics, and observed and examined by these expert panelists to comparatively evaluate a sense of discomfort in appearance from a right cheek of the subject as well as concealability against the facial skin spots according to the following evaluation ratings. The total value of the evaluation points given to the colored nonwoven fabric or the colored coating film by the 10 expert panelists was regarded as a score for the evaluation. The results are shown in Tables 4 and 5.

(Evaluation Ratings)

3 Points: No sense of discomfort occurred in comparison with the right cheek, and any facial skin spots were not recognized.

2 Points: Although no sense of discomfort occurred in comparison with the right cheek, facial skin spots were slightly recognized.

1 Point: A slight sense of discomfort occurred in comparison with the right cheek, and facial skin spots were slightly recognized.

0 Point: A large sense of discomfort occurred in comparison with the right cheek.

Examples 2-1 to 2-12 and Comparative Examples 2-1 to 2-3

[Step 3]

A 45 years old male (one person) having an allergic tendency was selected as a subject, and an inner side of a wrist of his left hand was photographed. An image of venous vessels only was extracted from the photographed image, and an inverted image of the aforementioned extracted image of the venous vessels was prepared as an image pattern to be printed.

The image pattern of the venous vessels was printed on the uneven-shaped surface of the respective colored nonwoven fabrics or colored coating films obtained in Examples 1-1 to 1-12 and Comparative Examples 1-1 to 1-3 using the water-based ink 5 for ink-jet printing as shown in Table 3 which was prepared in the same manner as used for production of the aforementioned water-based ink 1 for ink-jet printing by the same ink-jet printing method as described in the aforementioned Example 1-2 to evaluate concealability of the respective colored nonwoven fabrics or colored coating films according to the following evaluation method.

TABLE 3

| | | |
|---|---|---|
| No. of water-based ink | | 5 |
| Formulation of water-based ink (part(s) by mass) | Colorant water dispersion 1 (Yellow No. 5) | 0.0 |
| | Colorant water dispersion 2 (Yellow No. 4) | 5.4 |
| | Colorant water dispersion 3 (Blue No. 1) | 3.2 |
| | Colorant water dispersion 4 (Red No. 104-(1)) | 0.0 |
| | Colorant water dispersion 5 (Red No. 226) | 4.2 |
| | Colorant water dispersion 6 (White) | 0.0 |
| | PEG400 | 4 |
| | 1,2-Hexanediol | 3.8 |

TABLE 3-continued

| | |
|---|---|
| 1,2-Propanediol | 7.2 |
| Liponic EG-1 | 4 |
| Ion-exchanged water*1 | Balance |

Note

*1Balance in 100 parts by mass in total of water-based ink

[Concealability (Against Scars on Wrist)]

The inner side of the wrist of the left hand of the same subject as photographed above was rubbed with a nail to get a red wale thereon.

Then, the wrist of the left hand of the subject was washed with a commercially available facial cleaner, and then the water droplets remained attached thereonto were removed by wiping off them with a towel, and then the inner side of the wrist of the left hand and its surrounding portions of the subject were wet with the same milky lotion as used above for evaluating the flexibility. Next, the respective colored nonwoven fabrics obtained in Examples 2-1 to 2-12 and Comparative Examples 2-1 to 2-3 onto which the image pattern of the venous vessels was additionally printed, were attached, in the state before peeling off them from the collector, onto the inner side of the wrist of the left hand on which the wale was present. Then, the collector was peeled off and removed from the colored nonwoven fabric, so that the colored nonwoven fabric was attached and transferred to the region immediately above the wale and its surrounding portions.

The wrist of the left hand of the subject to which the colored nonwoven fabric was attached was presented to 10 expert panelists for cosmetics, and observed and examined by these expert panelists to comparatively evaluate a sense of discomfort in appearance from a wrist of a right hand of the subject as well as concealability against the wale portion according to the following evaluation ratings. The total value of the evaluation points given to the colored nonwoven fabric by the 10 expert panelists was regarded as a score for the evaluation. The results are shown in Tables 4 and 5.

(Evaluation Ratings)

3 Points: No sense of discomfort in appearance with respect to the blood vessels and skin was caused as compared to the wrist of the right hand, and the wale portion on the skin was not recognized at all.

2 Points: Although no sense of discomfort in appearance with respect to the blood vessels and skin was caused as compared to the wrist of the right hand, the wale portion on the skin was slightly recognized.

1 Point: A slight sense of discomfort in appearance with respect to the blood vessels and skin was caused as compared to the wrist of the right hand, and the wale portion on the skin was slightly recognized.

0 Point: A large sense of discomfort in appearance with respect to the blood vessels and skin was caused as compared to the wrist of the right hand.

TABLE 4-1

| | | | Examples | | | | | | Com. Ex. | | |
|---|---|---|---|---|---|---|---|---|---|---|---|
| | | | 1-1 | 1-2 | 1-3 | 1-4 | 1-5 | 1-6 | 1-1 | 1-2 | 1-3 |
| Preparation of injection liquid | No. of injection liquid | | 1 | 2 | 3 | 1 | 2 | 3 | 1 | | 1 |
| | Formulation of injection liquid (part(s) by mass) | Colorant water dispersion 1 (Yellow No. 5) | 7.2 | 0.0 | 0.0 | 7.2 | 0.0 | 0.0 | 7.2 | | 7.2 |
| | | Colorant water dispersion 2 (Yellow No. 4) | 0.0 | 0.0 | 0.0 | 0.0 | 0.0 | 0.0 | 0.0 | | 0.0 |
| | | Colorant water dispersion 3 (Blue No. 1) | 0.0 | 0.0 | 0.0 | 0.0 | 0.0 | 0.0 | 0.0 | | 0.0 |
| | | Colorant water dispersion 4 (Red No. 104-(1)) | 1.9 | 0.0 | 0.0 | 1.9 | 0.0 | 0.0 | 1.9 | | 1.9 |
| | | Colorant water dispersion 5 (Red No. 226) | 0.0 | 0.0 | 0.0 | 0.0 | 0.0 | 0.0 | 0.0 | | 0.0 |
| | | Colorant water dispersion 6 (White) | 30.0 | 30.0 | 0.0 | 30.0 | 30.0 | 0.0 | 30.0 | | 30.0 |
| | | Resin solution 1 (polyvinyl alcohol) | 61.0 | 61.0 | 61.0 | 61.0 | 61.0 | 61.0 | 61.0 | | 61.0 |

TABLE 4-1-continued

| | | | Examples | | | | | | Com. Ex. | | |
|---|---|---|---|---|---|---|---|---|---|---|---|
| | | | 1-1 | 1-2 | 1-3 | 1-4 | 1-5 | 1-6 | 1-1 | 1-2 | 1-3 |
| | | Resin solution 2 (alkali-soluble cellulose) | 0 | 0 | 0 | 0 | 0 | 0 | 0 | | 0 |
| | | Ion-exchanged water | 0 | 9.0 | 39.0 | 0 | 9.0 | 39.0 | 0 | | 0 |
| | Content (%) in injection liquid | Colorant white | 6.0 | 6.0 | 0.0 | 6.0 | 6.0 | 0.0 | 6.0 | | 6.0 |
| | | Colorant yellow | 1.4 | 0.0 | 0.0 | 1.4 | 0.0 | 0.0 | 1.4 | | 1.4 |
| | | Colorant blue | 0.0 | 0.0 | 0.0 | 0.0 | 0.0 | 0.0 | 0.0 | | 0.0 |
| | | Colorant red | 0.4 | 0.0 | 0.0 | 0.4 | 0.0 | 0.0 | 0.4 | | 0.4 |
| | | Polymer compound A | 9.2 | 9.2 | 9.2 | 9.2 | 9.2 | 9.2 | 9.2 | | 9.2 |
| | Content (%) of colorant based on content of polymer compound A in injection liquid | | 85 | 66 | 0 | 85 | 66 | 0 | 85 | | 85 |
| Electro-spinning | Injection conditions | Kind of collector | Texture sample 1 | | | SUPULARE | | SUPULARE | LUMIRROR | | Texture sample 1 |
| | | Voltage applied (kV) | 20 | 20 | 20 | 20 | 20 | 20 | 20 | | Wire bar coating |
| | | Distance (mm) between tip end of capillary and skin texture-reproduced surface of collector | 100 | 100 | 100 | 100 | 100 | 100 | 100 | | |
| | | Average injection amount (mL/min) of injection liquid | 1 | 1 | 1 | 1 | 1 | 1 | 1 | | |
| | | Environmental temperature (° C.) | 25 | 25 | 25 | 25 | 25 | 25 | 25 | | 25 |
| | | Environmental humidity (% RH) | 40 | 40 | 40 | 40 | 40 | 40 | 40 | | 40 |

TABLE 4-2

| | | | Examples | | | | | | Com. Ex. | | |
|---|---|---|---|---|---|---|---|---|---|---|---|
| | | | 1-1 | 1-2 | 1-3 | 1-4 | 1-5 | 1-6 | 1-1 | 1-2 | 1-3 |
| Preparation of water-based ink | Formulation of water-based ink (part(s) by mass) | No. of water-based ink | | 1 | 2 | | 1 | 2 | | 2 | |
| | | Colorant water dispersion 1 (Yellow No. 5) | | 7.2 | 7.2 | | 7.2 | 7.2 | | 7.2 | |
| | | Colorant water dispersion 2 (Yellow No. 4) | | 0.0 | 0.0 | | 0.0 | 0.0 | | 0.0 | |
| | | Colorant water dispersion 3 (Blue No. 1) | | 0.0 | 0.0 | | 0.0 | 0.0 | | 0.0 | |
| | | Colorant water dispersion 4 (Red No. 104-(1)) | | 1.9 | 1.9 | | 1.9 | 1.9 | | 1.9 | |
| | | Colorant water dispersion 5 (Red No. 226) | | 0.0 | 0.0 | | 0.0 | 0.0 | | 0.0 | |
| | | Colorant water dispersion 6 (White) | | 0.0 | 30.0 | | 0.0 | 30.0 | | 30.0 | |
| | | PEG400 | | 4.0 | 4.0 | | 4.0 | 4.0 | | 4.0 | |
| | | 1,2-Hexanediol | | 3.8 | 3.8 | | 3.8 | 3.8 | | 3.8 | |
| | | 1,2-Propanediol | | 7.2 | 0.0 | | 7.2 | 0.0 | | 16.1 | |
| | | Liponic EG-1 | | 4.0 | 4.0 | | 4.0 | 4.0 | | 4.0 | |
| | | Ion-exchanged water*1 | | Balance | Balance | | Balance | Balance | | Balance | |
| Evaluation | Flexibility | | 2 | 3 | 3 | 2 | 3 | 3 | 1 | 3 | 1 |
| | Rub fastness | | 2 | 3 | 3 | 2 | 3 | 3 | 1 | 3 | 1 |
| | Glossiness | | 10.3 | 12.4 | 14.5 | 3.9 | 5.2 | 7.3 | 51.0 | 12.0 | 58.0 |
| | Concealability (against spots on face) | | 18 | 21 | 22 | 15 | 17 | 18 | 6 | 0 | 0 |

| | Examples | | | | | | Com. Ex. | | |
|---|---|---|---|---|---|---|---|---|---|
| | 2-1 | 2-2 | 2-3 | 2-4 | 2-5 | 2-6 | 2-1 | 2-2 | 2-3 |
| Evaluation for concealability (scores on wrist) | 20 | 22 | 24 | 16 | 18 | 18 | 7 | 0 | 0 |

Note

*1Balance in 100 parts by mass in total of water-based ink

TABLE 5-1

| | | | Examples | | | | | |
|---|---|---|---|---|---|---|---|---|
| | | | 1-7 | 1-8 | 1-9 | 1-10 | 1-11 | 1-12 |
| Preparation of injection liquid | No. of injection liquid | | 4 | 5 | 6 | 4 | 5 | 6 |
| | Formulation of injection liquid (part(s) by mass) | Colorant water dispersion 1 (Yellow No. 5) | 2.4 | 0.0 | 0.0 | 2.4 | 0.0 | 0.0 |
| | | Colorant water dispersion 2 (Yellow No. 4) | 0.0 | 0.0 | 0.0 | 0.0 | 0.0 | 0.0 |
| | | Colorant water dispersion 3 (Blue No. 1) | 0.0 | 0.0 | 0.0 | 0.0 | 0.0 | 0.0 |
| | | Colorant water dispersion 4 (Red No. 104-(1)) | 0.6 | 0.0 | 0.0 | 0.6 | 0.0 | 0.0 |
| | | Colorant water dispersion 5 (Red No. 226) | 0.0 | 0.0 | 0.0 | 0.0 | 0.0 | 0.0 |
| | | Colorant water dispersion 6 (White) | 10.0 | 10.0 | 0.0 | 10.0 | 10.0 | 0.0 |
| | | Resin solution 1 (polyvinyl alcohol) | 0.0 | 0.0 | 0.0 | 0.0 | 0.0 | 0.0 |
| | | Resin solution 2 (alkali-soluble cellulose) | 87.0 | 87.0 | 87.0 | 87.0 | 87.0 | 87.0 |

TABLE 5-1-continued

| | | | Examples | | | | | |
|---|---|---|---|---|---|---|---|---|
| | | | 1-7 | 1-8 | 1-9 | 1-10 | 1-11 | 1-12 |
| | Content (%) in injection liquid | Ion-exchanged water | 0.0 | 3.0 | 13.0 | 0.0 | 3.0 | 13.0 |
| | | Colorant white | 2.0 | 2.0 | 0.0 | 2.0 | 2.0 | 0.0 |
| | | Colorant yellow | 0.5 | 0.0 | 0.0 | 0.5 | 0.0 | 0.0 |
| | | Colorant blue | 0.0 | 0.0 | 0.0 | 0.0 | 0.0 | 0.0 |
| | | Colorant red | 0.1 | 0.0 | 0.0 | 0.1 | 0.0 | 0.0 |
| | | Polymer compound A | 4.4 | 4.4 | 4.4 | 4.4 | 4.4 | 4.4 |
| | Content (%) of colorant based on content of polymer compound A in injection liquid | | 60 | 46 | 0 | 60 | 46 | 0 |
| Electro-spinning | Injection conditions | Kind of collector | Texture sample 1 | | | SUPULARE | | |
| | | Voltage applied (kV) | 27 | 27 | 27 | 27 | 27 | 27 |
| | | Distance (mm) between tip end of capillary and skin texture-reproduced surface of collector | 180 | 180 | 180 | 180 | 180 | 180 |
| | | Average injection amount (mL/min) of injection liquid | 1 | 1 | 1 | 1 | 1 | 1 |
| | | Environmental temperature (° C.) | 40 | 40 | 40 | 40 | 40 | 40 |
| | | Environmental humidity (% RH) | 20 | 20 | 20 | 20 | 20 | 20 |

TABLE 5-2

| | | | Examples | | | | | |
|---|---|---|---|---|---|---|---|---|
| | | | 1-7 | 1-8 | 1-9 | 1-10 | 1-11 | 1-12 |
| Preparation of water-based ink | Formulation of water-based ink (part(s) by mass) | No. of water-based ink | | 3 | 4 | | 3 | 4 |
| | | Colorant water dispersion 1 (Yellow No. 5) | | 2.4 | 2.4 | | 2.4 | 2.4 |
| | | Colorant water dispersion 2 (Yellow No. 4) | | 0.0 | 0.0 | | 0.0 | 0.0 |
| | | Colorant water dispersion 3 (Blue No. 1) | | 0.0 | 0.0 | | 0.0 | 0.0 |
| | | Colorant water dispersion 4 (Red No. 104-(1)) | | 0.6 | 0.6 | | 0.6 | 0.6 |
| | | Colorant water dispersion 5 (Red No. 226) | | 0.0 | 0.0 | | 0.0 | 0.0 |
| | | Colorant water dispersion 6 (White) | | 0.0 | 10.0 | | 0.0 | 10.0 |
| | | PEG400 | | 4.0 | 4.0 | | 4.0 | 4.0 |
| | | 1,2-Hexanediol | | 3.8 | 3.8 | | 3.8 | 3.8 |
| | | 1,2-Propanediol | | 11.1 | 4.0 | | 11.1 | 4.0 |
| | | Liponic EG-1 | | 4.0 | 4.0 | | 4.0 | 4.0 |
| | | Ion-exchanged water*[1] | | Balance | Balance | | Balance | Balance |
| Evaluation | Flexibility | | 2 | 3 | 3 | 2 | 3 | 3 |
| | Rub fastness | | 2 | 3 | 3 | 2 | 3 | 3 |
| | Glossiness | | 13.3 | 15.5 | 18.0 | 10.2 | 12.1 | 13.9 |
| | Concealability (against spots on face) | | 22 | 26 | 26 | 19 | 22 | 22 |

| | Examples | | | | | |
|---|---|---|---|---|---|---|
| | 2-7 | 2-8 | 2-9 | 2-10 | 2-11 | 2-12 |
| Evaluation for concealability (against scars on wrist) | 23 | 26 | 26 | 18 | 20 | 22 |

Note
*[1]Balance in 100 parts by mass in total of water-based ink

From Tables 4 and 5, it was confirmed that the colored nonwoven fabrics obtained in Examples 1-1 to 1-12 were excellent in flexibility, rub fastness and concealability, and further exhibited a high sense of unity with the skin in appearance and a gloss feel and a transparent feel close to those of a human skin, as compared to the colored nonwoven fabrics obtained in Comparative Examples 1-1 to 1-3.

In addition, it was confirmed that the colored nonwoven fabrics obtained in Examples 2-1 to 2-12 had high concealability against deep scores which had been conventionally difficult to conceal, as compared to the colored nonwoven fabrics obtained in Comparative Examples 2-1 to 2-3.

Furthermore, as shown in the enlarged photograph of FIG. 4, it was confirmed that the uneven surface shape of the artificial leather used as the collector was well transferred to the surface of the resulting respective colored nonwoven fabrics.

Example 3-1

[Step 1-1]

The same procedure as in Example 1-1 was repeated except that the following texture sample 2 was used as a collector having an uneven shape on a surface thereof, and the injection liquid 1 was replaced with the injection liquid 2 shown in Table 6, thereby obtaining a colored nonwoven fabric laminated on the surface of the collector.

[Step 3]

Figure 3:
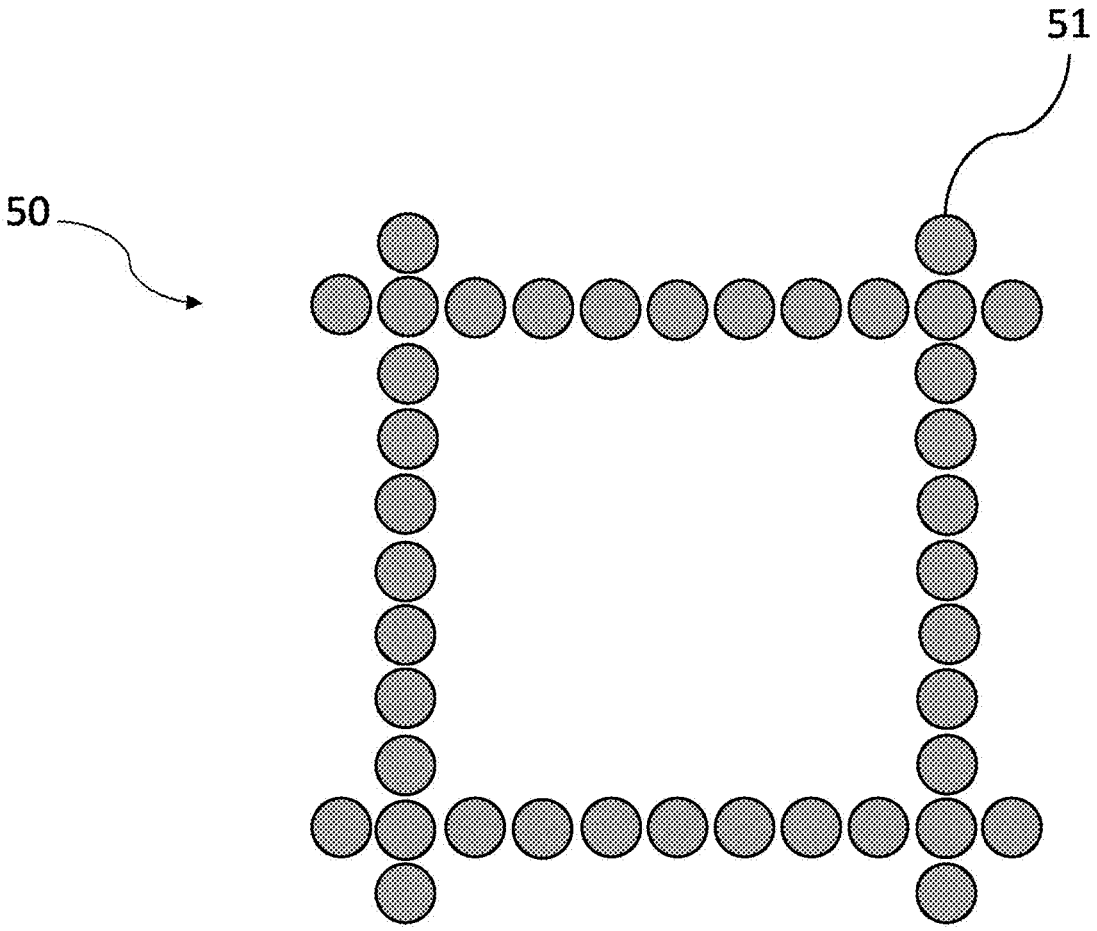
FIG. 3 is an enlarged view of a square grid image used in an ink-jet printing method in Examples 3-1 and 3-2.

An image of a square grid in which the width of each line was constituted of one dot (line width: about 34 μm), and the number of dots constituting one side of the square grid was 9 (line width: about 300 μm) as shown in FIG. 3 was printed on the uneven-shaped surface of the colored nonwoven fabric obtained in the step 1-1 using the water-based ink 6 for ink-jet printing shown in Table 6 which was prepared in the same manner as used for production of the aforementioned water-based ink 1 for ink-jet printing by the same ink-jet qprinting method as described above in Example 1-2, thereby obtaining a colored nonwoven fabric laminated on the surface of the collector.

Texture sample 2: Texture sample plate "MTJ-602" formed of nylon 66 (kind: micro mat; texture depth: 130 μm; draft angle: 14°) available from Mold-Tech Japan Co., Ltd.

Example 3-2

[Step 2-1]

The aforementioned texture sample 2 was used as a collector having an uneven shape on a surface thereof. The injection liquid 3 shown in Table 6 was filled in a syringe of a resin solution-type electrospinning apparatus "Nanofiber Electrospinning Unit", and injected onto the skin texture-reproduced surface of the collector under the injection conditions shown in Table 6 to deposit nanofibers on a region of 3 cm in width and 5 cm in length on the skin texture-reproduced surface.

Next, the nanofibers deposited on the surface of the collector were subjected to heat treatment at 180° C. for 20 minutes, so that the completely saponified polyvinyl alcohol in the nanofibers was crystallized and subjected to water-insolubilizing treatment, thereby obtaining an uncolored nonwoven fabric laminated on the surface of the collector.

[Step 2-2]

Ink-jet printing was conducted on the uneven-shaped surface of the uncolored nonwoven fabric obtained in the step 2-1 using the water-based ink 7 for ink-jet printing shown in Table 6 by the same method as in Example 1-3 except that the aforementioned square grid image was used in place of the solid image, thereby obtaining a colored nonwoven fabric laminated on the surface of the collector.

[Adjustment of Skin Color by Ink-Jet Printing Method]

A 40 years old female (one person) who felt that her skin texture was rough due to aging and her skin color became dull was selected as a subject.

A whole part of the face of the subject was washed with a commercially available facial cleaner, and then the water droplets remained attached thereonto were removed by wiping off them with a towel. Then, the cheek of the subject was wet with the same milky lotion as used above for evaluating the flexibility. Next, the colored nonwoven fabric obtained in each of Examples 3-1 and 3-2 in the state before being peeled off from the collector was attached onto a right cheek of the face of the subject. Then, the collector was peeled off and removed from the colored nonwoven fabric, so that the colored nonwoven fabric was attached and transferred to the right cheek of the face of the subject.

Then, the right cheek of the subject onto which the colored nonwoven fabric was attached was presented to 10 expert panelists for cosmetics, and observed by these expert panelists to examine the difference in appearance of the right cheek from the left cheek as well as dullness of the skin, and comparatively evaluate the effect of adjusting the skin color according to the following evaluation ratings. The total value of the evaluation points given to the colored nonwoven fabric by the 10 expert panelists was regarded as a score for the evaluation.

(Evaluation Ratings)

3 Points: The right cheek apparently exhibited a light skin color as compared to the left cheek, and had such a transparent feel and natural look like a bare skin with no makeup.

2 Points: The right cheek exhibited a light skin color as compared to the left cheek, and had such a natural impression that light makeup having a transparent feel was applied thereto.

1 Point: The right cheek had such an unnatural impression that uniform thick makeup was applied thereto.

0 Point: The right cheek had a sense of discomfort as compared to the left cheek, and it was apparently recognized that makeup was applied only to the right cheek.

TABLE 6-1

| | | | Examples | |
|---|---|---|---|---|
| | | | 3-1 | 3-2 |
| Preparation of injection liquid | No. of injection liquid | | 2 | 3 |
| | Formulation of injection liquid (part(s) by mass) | Colorant water dispersion 1 (Yellow No. 5) | 0.0 | 0.0 |
| | | Colorant water dispersion 2 (Yellow No. 4) | 0.0 | 0.0 |
| | | Colorant water dispersion 3 (Blue No. 1) | 0.0 | 0.0 |
| | | Colorant water dispersion 4 (Red No. 104-(1)) | 0.0 | 0.0 |
| | | Colorant water dispersion 5 (Red No. 226) | 0.0 | 0.0 |
| | | Colorant water dispersion 6 (White) | 30.0 | 0.0 |
| | | Resin solution 1 (polyvinyl alcohol) | 61.0 | 61.0 |
| | | Resin solution 2 (alkali-soluble cellulose) | 0.0 | 0.0 |
| | | Ion-exchanged water | 9.0 | 39.0 |
| | Content (%) in injection liquid | Colorant white | 6.0 | 0.0 |
| | | Colorant yellow | 0.0 | 0.0 |
| | | Colorant blue | 0.0 | 0.0 |
| | | Colorant red | 0.0 | 0.0 |
| | | Polymer compound A | 9.2 | 9.2 |
| | Content (%) of colorant based on content of polymer compound A in injection liquid | | 66 | 0 |
| Electro spinning | Injection conditions | Kind of collector | Texture sample 2 | |
| | | Voltage applied (kV) | 20 | 20 |
| | | Distance (mm) between tip end of capillary and skin texture-reproduced surface of collector | 100 | 100 |
| | | Average injection amount (mL/min) of injection liquid | 1 | 1 |
| | | Environmental temperature (° C.) | 25 | 25 |
| | | Environmental humidity (% RH) | 40 | 40 |

TABLE 6-2

| | | | Examples | |
|---|---|---|---|---|
| | | | 3-1 | 3-2 |
| Preparation of water-based ink | Formulation of water-based ink (part(s) by mass) | No. of water-based ink | 6 | 7 |
| | | Colorant water dispersion 1 (Yellow No. 5) | 0.0 | 0.0 |
| | | Colorant water dispersion 2 (Yellow No. 4) | 4.0 | 4.0 |
| | | Colorant water dispersion 3 (Blue No. 1) | 0.0 | 0.0 |
| | | Colorant water dispersion 4 (Red No. 104-(1)) | 0.0 | 0.0 |
| | | Colorant water dispersion 5 (Red No. 226) | 2.0 | 2.0 |
| | | Colorant water dispersion 6 (White) | 0.0 | 10.0 |
| | | PEG400 | 4 | 4 |
| | | 1,2-Hexanediol | 3.8 | 3.8 |
| | | 1,2-Propanediol | 7.2 | 0 |
| | | Liponic EG-1 | 4 | 4 |
| | | Ion-exchanged water*1 | Balance | Balance |
| Evaluation | Effect of adjusting skin color by ink-jet printing method | | 24 | 21 |

Note
*1Balance in 100 parts by mass in total of water-based ink

From Table 6, it was confirmed that the colored nonwoven fabrics obtained in Examples 3-1 and 3-2 were excellent in effect of adjusting a skin color by the ink-jet printing method.

INDUSTRIAL APPLICABILITY

The colored nonwoven fabric obtained by the production process of the present invention is excellent in flexibility, rub fastness and concealability, and further has a sense of unity with a skin in appearance as well as a gloss feel and a transparent feel close to those of a human skin. Therefore, the colored nonwoven fabric can be used not only as a concealing seal for hiding scars, etc., by directly attaching to a skin of a user, but also as a makeup seal by further applying precise makeup to an uncolored nonwoven fabric or a colored nonwoven fabric obtained therefrom by printing.

REFERENCE SIGNS LIST

30: Resin solution-type electrospinning apparatus
40: Resin melt-type electrospinning apparatus
31, 41: Syringe
32, 42: High voltage supply
33, 43: Collector
44: Heater
31*a*, 41*a*: Cylinder
31*b*, 41*b*: Plunger
31*c*, 41*c*: Capillary
32*a*, 42*a*: Positive electrode
32*b*, 42*b*: Negative electrode
50: Square grid image
51: Dots constituting a square grid image

The invention claimed is:

1. A process for producing a colored nonwoven fabric that comprises a colorant and nanofibers, the process comprising:

photographing and analyzing a skin portion to which the colored nonwoven fabric is to be attached;

creating an at least partially textured surface of a collector based on the results of the photographing and analyzing; and injecting a polymer compound A by a resin melt-type electrospinning method in which a solid resin is heated and melted to produce a molten resin, and the molten resin is physically forced while a voltage is applied between the resin and the collector to deposit the nanofibers on the at least partially textured surface of the collector, wherein the at least partially textured surface imitates a surface configuration of a skin.

2. The process for producing a colored nonwoven fabric according to claim 1, further comprising:

Step 1-1: injecting the polymer compound A and the colorant at the same time by the electrospinning method to deposit the nanofibers comprising the colorant on the at least partially textured surface of the collector, thereby obtaining the colored nonwoven fabric.

3. The process for producing a colored nonwoven fabric according to claim 2, wherein an injection liquid comprising the polymer compound A and the colorant is used in the step 1-1.

4. The process for producing a colored nonwoven fabric according to claim 3, wherein a content of the polymer compound A in the injection liquid used in the step 1-1 is not less than 2% by mass and not more than 20% by mass.

5. The process for producing a colored nonwoven fabric according to claim 3, wherein a mass ratio of a content of the colorant to the content of the polymer compound A in the injection liquid is not less than 0.30 and not more than 1.10 as calculated assuming that the content of the polymer compound A in the injection liquid is 100% by mass.

6. The process for producing a colored nonwoven fabric according to claim 1, further comprising:

Step 2-1: injecting the polymer compound A by an electrospinning method to deposit the nanofibers on the at least partially textured surface of the collector to obtain an uncolored nonwoven fabric; and Step 2-2: applying the colorant to the uncolored nonwoven fabric obtained in the step 2-1 by an ink-jet printing method to obtain the colored nonwoven fabric.

7. The process for producing a colored nonwoven fabric according to claim 6, wherein a content of the polymer compound A in an injection liquid used in the step 2-1 is not less than 2% by mass and not more than 20% by mass.

8. The process for producing a colored nonwoven fabric according to claim 6, wherein the colorant is used in the step 2-2 in the form of a water-based ink.

9. The process for producing a colored nonwoven fabric according to claim 1, wherein the polymer compound A comprises a water-insoluble polymer compound.

10. The process for producing a colored nonwoven fabric according to claim 9, wherein the water-insoluble polymer compound is derived from a water-soluble polymer compound that has water-solubility, but is rendered water-insoluble when subjecting it to water-insolubilizing treatment.

11. The process for producing a colored nonwoven fabric according to claim 10, wherein the water-insoluble polymer compound is at least one compound selected from the group consisting of a completely saponified polyvinyl alcohol and an alkali-soluble cellulose.

12. The process for producing a colored nonwoven fabric according to claim 1, wherein the colorant is in the form of colorant-containing polymer particles.

13. The process for producing a colored nonwoven fabric according to claim 2, further comprising:

Step 3: applying a colorant to the resulting colored nonwoven fabric by an ink-jet printing method to obtain a colored nonwoven fabric which is further colored with the colorant.

14. The process for producing a colored nonwoven fabric according to claim 1, wherein the texture imitating the surface configuration of the skin is a shape imitating the unevenness of the skin along the skin groove and the skin hill.

15. The process for producing a colored nonwoven fabric according to claim 6, wherein the method of applying the ink-jet printing method to the coloration is any one selected from the group consisting of a method of applying an ink containing the colorant to the preliminarily prepared uncolored nonwoven fabric by an ink-jet printing method, and a method of preliminarily applying an ink containing the colorant onto an uneven shape of the at least partially textured surface of the collector by an ink-jet printing method, and then depositing uncolored nanofibers of the uncolored nonwoven fabric on the uneven shape of the collector to which the colorant has been applied.

16. The process for producing a colored nonwoven fabric according to claim 11, wherein the water-insoluble polymer compound is an alkali-soluble cellulose.

* * * * *